US007952601B2

(12) United States Patent
Koizumi et al.

(10) Patent No.: US 7,952,601 B2
(45) **Date of Patent: *May 31, 2011**

(54) LENS ARRAY, EXPOSURE HEAD, AND IMAGE FORMING APPARATUS

(75) Inventors: Ryuta Koizumi, Shiojiri (JP); Yujiro Nomura, Shiojiri (JP); Takeshi Sowa, Matsumoto (JP); Ken Ikuma, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 52 days.

This patent is subject to a terminal disclaimer.

(21) Appl. No.: 12/358,042

(22) Filed: Jan. 22, 2009

(65) Prior Publication Data

US 2009/0189970 A1 Jul. 30, 2009

(30) Foreign Application Priority Data

Jan. 28, 2008 (JP) ..... 2008-016047
Nov. 28, 2008 (JP) ..... 2008-304815

(51) Int. Cl.
*B41J 2/45* (2006.01)

(52) U.S. Cl. ..... 347/238

(58) Field of Classification Search ..... 347/230, 347/241, 242, 244, 256–258, 238; 359/619, 359/625, 628, 738–741
See application file for complete search history.

(56) References Cited

U.S. PATENT DOCUMENTS

| | | | | |
|---|---|---|---|---|
| 4,734,734 | A * | 3/1988 | Yano | 399/186 |
| 5,023,442 | A * | 6/1991 | Taniguchi et al. | 250/208.1 |
| 5,363,240 | A * | 11/1994 | Miyashita | 359/625 |
| 7,432,947 | B2 * | 10/2008 | Yosuke | 347/244 |
| 2009/0190228 | A1 * | 7/2009 | Koizumi et al. | 359/619 |

FOREIGN PATENT DOCUMENTS

| | | |
|---|---|---|
| JP | 06-278314 | 10/1994 |
| JP | 2005-276849 | 10/2005 |

* cited by examiner

*Primary Examiner* — Hai C Pham
(74) *Attorney, Agent, or Firm* — DLA Piper LLP (US)

(57) ABSTRACT

An exposure head includes: a lens array in which lenses are disposed in a first direction; and a light-emitting element substrate on which light-emitting elements that emit light to be focused by the lenses are disposed. Length L1 of the lenses in the first direction and length L2 of the lenses in a second direction orthogonal to the first direction have a relation represented by an expression 1<L2/L1.

11 Claims, 32 Drawing Sheets

LGD
LTD
PTE
PTE
PTE
PTE
Peg
Peg
Peg
295R
295R
295R
295
295
295

OPTICAL SYSTEM PARAMETERS

| ITEM | VALUE |
|---|---|
| WAVELENGTH | 690 [nm] |
| LENS LONGITUDINAL DIRECTION LENGTH L1 | 1.4 [mm] |
| LENS LATITUDINAL DIRECTION LENGTH L2 | 1.63 [mm] |

FIG.23

DATA OF OPTICAL SYSTEM

| SURFACE NUMBER | SURFACE TYPE | CURVATURE RADIUS | SURFACE INTERVAL | REFRACTIVE INDEX | ABBE NUMBER |
|---|---|---|---|---|---|
| S1 (OBJECT SURFACE) | | ∞ | 0.55 | $n_d$=1.5168 | $\nu_d$=64.2 |
| S2 | | ∞ | 4.206 | | |
| S3 (DIAPHRAGM SURFACE) | | ∞ | 0.03 | | |
| S4 | XY POLYNOMIAL SURFACE | SEE FIG. 26 | 0.26 | $n_d$=1.53 | $\nu_d$=50.8 |
| S5 | | ∞ | 0.9 | $n_d$=1.541 | $\nu_d$=57 |
| S6 | | ∞ | 1.393 | | |
| S7 | XY POLYNOMIAL SURFACE | SEE FIG. 27 | 0.29 | $n_d$=1.53 | $\nu_d$=50.8 |
| S8 | | ∞ | 0.9 | $n_d$=1.541 | $\nu_d$=57 |
| S9 | | ∞ | 0.879 | | |
| S10 (IMAGE PLANE) | | ∞ | | | |

FIG.24

- DEFINITION OF XY POLYNOMIAL SURFACE EQUATION USED FOR DEFINITION IS AS FOLLOWS:

$$z(x, y) = \frac{cr^2}{1 + \sqrt{1 - (1 + k)c^2r^2}} + \sum_{j=2}^{66} C_j x^n y^m$$

$$j = [(m + n)^2 + m + 3n]/2 + 1$$

WHERE, z : SAG AMOUNT OF PLANE PARALLEL TO z AXIS
c : CURVATURE AT SURFACE VERTEX
k : CONIC COEFFICIENT
Cj : COEFFICIENT OF MONADIC EXPRESSION $x^m y^n$
x : COORDINATE OF x AXIS (MAIN SCANNING DIRECTION)
y : COORDINATE OF y AXIS (SUB-SCANNING DIRECTION)

FIG.25

VALUES OF COEFFICIENTS FOR SURFACE S4

| COEFFICIENT NAME | | VALUE | COEFFICIENT NAME | | VALUE |
|---|---|---|---|---|---|
| CURVATURE c | | 0.61583 | | | |
| CONIC CONSTANT k | | -1.03580 | C34 | $x^2y^5$ | 0 |
| C2 | $x$ | 0 | C35 | $xy^6$ | 0 |
| C3 | $y$ | 0 | C36 | $y^7$ | 0 |
| C4 | $x^2$ | 0.029156 | C37 | $x^8$ | 0 |
| C5 | $xy$ | 0 | C38 | $x^7y$ | 0 |
| C6 | $y^2$ | 0.029554 | C39 | $x^6y^2$ | 0 |
| C7 | $x^3$ | 0 | C40 | $x^5y^3$ | 0 |
| C8 | $x^2y$ | 0 | C41 | $x^4y^4$ | 0 |
| C9 | $xy^2$ | 0 | C42 | $x^3y^5$ | 0 |
| C10 | $y^3$ | 0 | C43 | $x^2y^6$ | 0 |
| C11 | $x^4$ | 5.3207E-04 | C44 | $xy^7$ | 0 |
| C12 | $x^3y$ | 0 | C45 | $y^8$ | 0 |
| C13 | $x^2y^2$ | 4.6625E-03 | C46 | $x^9$ | 0 |
| C14 | $xy^3$ | 0 | C47 | $x^8y$ | 0 |
| C15 | $y^4$ | 3.2119E-03 | C48 | $x^7y^2$ | 0 |
| C16 | $x^5$ | 0 | C49 | $x^6y^3$ | 0 |
| C17 | $x^4y$ | 0 | C50 | $x^5y^4$ | 0 |
| C18 | $x^3y^2$ | 0 | C51 | $x^4y^5$ | 0 |
| C19 | $x^2y^3$ | 0 | C52 | $x^3y^6$ | 0 |
| C20 | $xy^4$ | 0 | C53 | $x^2y^7$ | 0 |
| C21 | $y^5$ | 0 | C54 | $xy^8$ | 0 |
| C22 | $x^6$ | 1.4859E-04 | C55 | $y^9$ | 0 |
| C23 | $x^5y$ | 0 | C56 | $x^{10}$ | 0 |
| C24 | $x^4y^2$ | -1.5016E-03 | C57 | $x^9y$ | 0 |
| C25 | $x^3y^3$ | 0 | C58 | $x^8y^2$ | 0 |
| C26 | $x^2y^4$ | 1.7973E-03 | C59 | $x^7y^3$ | 0 |
| C27 | $xy^5$ | 0 | C60 | $x^6y^4$ | 0 |
| C28 | $y^6$ | -2.7614E-03 | C61 | $x^5y^5$ | 0 |
| C29 | $x^7$ | 0 | C62 | $x^4y^6$ | 0 |
| C30 | $x^6y$ | 0 | C63 | $x^3y^7$ | 0 |
| C31 | $x^5y^2$ | 0 | C64 | $x^2y^8$ | 0 |
| C32 | $x^4y^3$ | 0 | C65 | $xy^9$ | 0 |
| C33 | $x^3y^4$ | 0 | C66 | $y^{10}$ | 0 |

FIG.26

VALUES OF COEFFICIENTS FOR SURFACE S7

| COEFFICIENT NAME | | VALUE | COEFFICIENT NAME | | VALUE |
|---|---|---|---|---|---|
| CURVATURE c | | 0.52055 | | | |
| CONIC CONSTANT k | | −7.15895 | C34 | $x^2y^5$ | 0 |
| C2 | $x$ | 0 | C35 | $xy^6$ | 0 |
| C3 | $y$ | 0 | C36 | $y^7$ | 0 |
| C4 | $x^2$ | 0.132693 | C37 | $x^8$ | 0 |
| C5 | $xy$ | 0 | C38 | $x^7y$ | 0 |
| C6 | $y^2$ | 0.127483 | C39 | $x^6y^2$ | 0 |
| C7 | $x^3$ | 0 | C40 | $x^5y^3$ | 0 |
| C8 | $x^2y$ | 0 | C41 | $x^4y^4$ | 0 |
| C9 | $xy^2$ | 0 | C42 | $x^3y^5$ | 0 |
| C10 | $y^3$ | 0 | C43 | $x^2y^6$ | 0 |
| C11 | $x^4$ | 8.7695E−02 | C44 | $xy^7$ | 0 |
| C12 | $x^3y$ | 0 | C45 | $y^8$ | 0 |
| C13 | $x^2y^2$ | 0.1537591 | C46 | $x^9$ | 0 |
| C14 | $xy^3$ | 0 | C47 | $x^8y$ | 0 |
| C15 | $y^4$ | 0.0699629 | C48 | $x^7y^2$ | 0 |
| C16 | $x^5$ | 0 | C49 | $x^6y^3$ | 0 |
| C17 | $x^4y$ | 0 | C50 | $x^5y^4$ | 0 |
| C18 | $x^3y^2$ | 0 | C51 | $x^4y^5$ | 0 |
| C19 | $x^2y^3$ | 0 | C52 | $x^3y^6$ | 0 |
| C20 | $xy^4$ | 0 | C53 | $x^2y^7$ | 0 |
| C21 | $y^5$ | 0 | C54 | $xy^8$ | 0 |
| C22 | $x^6$ | −0.07651391 | C55 | $y^9$ | 0 |
| C23 | $x^5y$ | 0 | C56 | $x^{10}$ | 0 |
| C24 | $x^4y^2$ | −0.2261404 | C57 | $x^9y$ | 0 |
| C25 | $x^3y^3$ | 0 | C58 | $x^8y^2$ | 0 |
| C26 | $x^2y^4$ | −0.2369140 | C59 | $x^7y^3$ | 0 |
| C27 | $xy^5$ | 0 | C60 | $x^6y^4$ | 0 |
| C28 | $y^6$ | −0.0296410 | C61 | $x^5y^5$ | 0 |
| C29 | $x^7$ | 0 | C62 | $x^4y^6$ | 0 |
| C30 | $x^6y$ | 0 | C63 | $x^3y^7$ | 0 |
| C31 | $x^5y^2$ | 0 | C64 | $x^2y^8$ | 0 |
| C32 | $x^4y^3$ | 0 | C65 | $xy^9$ | 0 |
| C33 | $x^3y^4$ | 0 | C66 | $y^{10}$ | 0 |

FIG.27

OPTICAL SYSTEM PARAMETERS

| ITEM | VALUE |
|---|---|
| WAVELENGTH | 690 nm |
| DIAPHRAGM SHAPE | ELLIPTICAL |
| DIAPHRAGM MAIN SCANNING DIAMETER La1 | 1.4 mm |
| DIAPHRAGM SUB-SCANNING DIAMETER La2 | 1.6 mm |
| RATIO La2/La1 (DIAPHRAGM) | 1.14 |
| FIRST LENS MAIN SCANNING WIDTH L1(1) | 1.66 mm |
| FIRST LENS SUB-SCANNING WIDTH L2(1) | 1.9 mm |
| RATIO L2(1)/L1(1) (FIRST LENS) | 1.14 |
| SECOND LENS MAIN SCANNING WIDTH L1(2) | 1.66 mm |
| SECOND LENS SUB-SCANNING WIDTH L2(2) | 2.0 mm |
| RATIO L2(2)/L1(2) (SECOND LENS) | 1.2 |
| LENS MAIN SCANNING EFFECTIVE DIAMETER | 1.56 mm |
| LENS SUB-SCANNING EFFECTIVE DIAMETER | 1.8 mm |
| NUMBER OF LENS ROWS | 1 |

FIG.30

DATA OF OPTICAL SYSTEM

| SURFACE NUMBER | SURFACE TYPE | CURVATURE RADIUS | SURFACE INTERVAL | REFRACTIVE INDEX |
|---|---|---|---|---|
| S1 (OBJECT SURFACE) | | ∞ | 0.55 | $n_d$=1.5168, $v_d$=64.2 |
| S2 | | ∞ | 4.156 | |
| S3 (DIAPHRAGM SURFACE) | | ∞ | -0.05 | |
| S4 | XY POLYNOMIAL SURFACE | FIG. 32 | 0.31 | $n_d$=1.53, $v_d$=50.8 |
| S5 | | ∞ | 0.9 | $n_d$=1.541, $v_d$=57 |
| S6 | | ∞ | 1.573 | |
| S7 | XY POLYNOMIAL SURFACE | FIG. 33 | 0.34 | $n_d$=1.53, $v_d$=50.8 |
| S8 | | ∞ | 0.9 | $n_d$=1.541, $v_d$=57 |
| S9 | | ∞ | 0.899 | |
| S10 (IMAGE PLANE) | | ∞ | | |

FIG.31

| COEFFICIENT NAME | | VALUE | COEFFICIENT NAME | | VALUE |
|---|---|---|---|---|---|
| CURVATURE c | | 0.66514 | | | |
| CONIC CONSTANT k | | −0.96639 | C34 | $x^2y^5$ | 0 |
| C2 | $x$ | 0 | C35 | $xy^6$ | 0 |
| C3 | $y$ | 0 | C36 | $y^7$ | 0 |
| C4 | $x^2$ | 0 | C37 | $x^8$ | 0 |
| C5 | $xy$ | 0 | C38 | $x^7y$ | 0 |
| C6 | $y^2$ | 0.017944 | C39 | $x^6y^2$ | 0 |
| C7 | $x^3$ | 0 | C40 | $x^5y^3$ | 0 |
| C8 | $x^2y$ | 0 | C41 | $x^4y^4$ | 0 |
| C9 | $xy^2$ | 0 | C42 | $x^3y^5$ | 0 |
| C10 | $y^3$ | 0 | C43 | $x^2y^6$ | 0 |
| C11 | $x^4$ | −0.0040627 | C44 | $xy^7$ | 0 |
| C12 | $x^3y$ | 0 | C45 | $y^8$ | 0 |
| C13 | $x^2y^2$ | −0.0044433 | C46 | $x^9$ | 0 |
| C14 | $xy^3$ | 0 | C47 | $x^8y$ | 0 |
| C15 | $y^4$ | −0.0043072 | C48 | $x^7y^2$ | 0 |
| C16 | $x^5$ | 0 | C49 | $x^6y^3$ | 0 |
| C17 | $x^4y$ | 0 | C50 | $x^5y^4$ | 0 |
| C18 | $x^3y^2$ | 0 | C51 | $x^4y^5$ | 0 |
| C19 | $x^2y^3$ | 0 | C52 | $x^3y^6$ | 0 |
| C20 | $xy^4$ | 0 | C53 | $x^2y^7$ | 0 |
| C21 | $y^5$ | 0 | C54 | $xy^8$ | 0 |
| C22 | $x^6$ | 0.0013566 | C55 | $y^9$ | 0 |
| C23 | $x^5y$ | 0 | C56 | $x^{10}$ | 0 |
| C24 | $x^4y^2$ | 0.0023148 | C57 | $x^9y$ | 0 |
| C25 | $x^3y^3$ | 0 | C58 | $x^8y^2$ | 0 |
| C26 | $x^2y^4$ | 0.0045271 | C59 | $x^7y^3$ | 0 |
| C27 | $xy^5$ | 0 | C60 | $x^6y^4$ | 0 |
| C28 | $y^6$ | 0.0016163 | C61 | $x^5y^5$ | 0 |
| C29 | $x^7$ | 0 | C62 | $x^4y^6$ | 0 |
| C30 | $x^6y$ | 0 | C63 | $x^3y^7$ | 0 |
| C31 | $x^5y^2$ | 0 | C64 | $x^2y^8$ | 0 |
| C32 | $x^4y^3$ | 0 | C65 | $xy^9$ | 0 |
| C33 | $x^3y^4$ | 0 | C66 | $y^{10}$ | 0 |

FIG.32

| COEFFICIENT NAME | | VALUE | COEFFICIENT NAME | | VALUE |
|---|---|---|---|---|---|
| CURVATURE c | | 0.84418 | | | |
| CONIC CONSTANT k | | −3.12083 | C34 | $x^2y^5$ | 0 |
| C2 | $x$ | 0 | C35 | $xy^6$ | 0 |
| C3 | $y$ | 0 | C36 | $y^7$ | 0 |
| C4 | $x^2$ | 0 | C37 | $x^8$ | 0 |
| C5 | $xy$ | 0 | C38 | $x^7y$ | 0 |
| C6 | $y^2$ | −0.037844 | C39 | $x^6y^2$ | 0 |
| C7 | $x^3$ | 0 | C40 | $x^5y^3$ | 0 |
| C8 | $x^2y$ | 0 | C41 | $x^4y^4$ | 0 |
| C9 | $xy^2$ | 0 | C42 | $x^3y^5$ | 0 |
| C10 | $y^3$ | 0 | C43 | $x^2y^6$ | 0 |
| C11 | $x^4$ | 0.14618 | C44 | $xy^7$ | 0 |
| C12 | $x^3y$ | 0 | C45 | $y^8$ | 0 |
| C13 | $x^2y^2$ | 0.27003 | C46 | $x^9$ | 0 |
| C14 | $xy^3$ | 0 | C47 | $x^8y$ | 0 |
| C15 | $y^4$ | 0.13889 | C48 | $x^7y^2$ | 0 |
| C16 | $x^5$ | 0 | C49 | $x^6y^3$ | 0 |
| C17 | $x^4y$ | 0 | C50 | $x^5y^4$ | 0 |
| C18 | $x^3y^2$ | 0 | C51 | $x^4y^5$ | 0 |
| C19 | $x^2y^3$ | 0 | C52 | $x^3y^6$ | 0 |
| C20 | $xy^4$ | 0 | C53 | $x^2y^7$ | 0 |
| C21 | $y^5$ | 0 | C54 | $xy^8$ | 0 |
| C22 | $x^6$ | −0.066142 | C55 | $y^9$ | 0 |
| C23 | $x^5y$ | 0 | C56 | $x^{10}$ | 0 |
| C24 | $x^4y^2$ | −0.24089 | C57 | $x^9y$ | 0 |
| C25 | $x^3y^3$ | 0 | C58 | $x^8y^2$ | 0 |
| C26 | $x^2y^4$ | −0.28288 | C59 | $x^7y^3$ | 0 |
| C27 | $xy^5$ | 0 | C60 | $x^6y^4$ | 0 |
| C28 | $y^6$ | −0.099210 | C61 | $x^5y^5$ | 0 |
| C29 | $x^7$ | 0 | C62 | $x^4y^6$ | 0 |
| C30 | $x^6y$ | 0 | C63 | $x^3y^7$ | 0 |
| C31 | $x^5y^2$ | 0 | C64 | $x^2y^8$ | 0 |
| C32 | $x^4y^3$ | 0 | C65 | $xy^9$ | 0 |

FIG.33

LENS ARRAY, EXPOSURE HEAD, AND IMAGE FORMING APPARATUS

CROSS REFERENCE TO RELATED ART

The disclosure of Japanese Patent Applications No. 2008-016047 filed on Jan. 28, 2008 and No. 2008-304815 filed on Nov. 28, 2008 including specification, drawings and claims is incorporated herein by reference in its entirety.

BACKGROUND

1. Technical Field

The present invention relates to a lens array that focuses light using lenses, an exposure head including the lens array, and an image forming apparatus including the exposure head.

2. Related Art

As such an exposure head, there is known a line head in which plural substantially circular lenses are arranged in a longitudinal direction as shown in, for example, FIG. 2 of JP-A-6-278314. In this line head, the lenses are arranged at a predetermined pitch in the longitudinal direction and focus light made incident from light-emitting elements. Latent image bearing members such as photoconductive drums are exposed by the light focused by the lenses and latent images are formed thereon.

From the viewpoint of satisfactorily performing exposure, an amount of the light made incident on the lenses is preferably large. Therefore, it is conceivable to, for example, increase the size of the lenses. However, since the lenses in the related art are substantially circular, when the lenses are increased in size, the lens pitch in the longitudinal direction (a first direction) increase. As a result, it is likely that predetermined resolution is not obtained. In other words, in the related art, resolution may fall at the cost of the increase in an amount of incident light on the lenses.

SUMMARY

An advantage of some aspects of the invention is to provide a technique that makes it possible to lead a large amount of light into lenses even at high resolution and realize satisfactory exposure.

According to an aspect of the invention, there is provided an exposure head including: a lens array in which lenses are disposed in a first direction; and a light-emitting element substrate on which light-emitting elements that emit light to be focused by the lenses are disposed, wherein length L1 of the lenses in the first direction and length L2 of the lenses in a second direction orthogonal to the first direction have a relation represented by an expression $1<L2/L1$.

According to another aspect of the invention, there is provided a lens array including lenses disposed in a first direction, wherein length L1 of the lenses in the first direction and length L2 of the lenses in a second direction orthogonal to the first direction have a relation represented by an expression $1<L2/L1$.

According to still another aspect of the invention, there is provided an image forming apparatus including an exposure head having a lens array in which lenses are arrayed in a first direction and a light-emitting element substrate on which light-emitting elements that emit light to be focused by the lenses are disposed, wherein length L1 of the lenses in the first direction and length L2 of the lenses in a second direction orthogonal to the first direction have a relation represented by an expression $1<L2/L1$.

In the aspects of the invention (the exposure head, the lens array, and the image forming apparatus), the length L1 of the lenses in the first direction and the length L2 of the lenses in the second direction orthogonal to or substantially orthogonal to the first direction satisfy the relation represented by the expression $1<L2/L1$. Therefore, it is possible to lead a large amount of light into the lenses in the second direction and realize satisfactory exposure without increasing a pitch of the lenses disposed in the first direction.

It is preferable that the length L1 of the lenses in the first direction and the length L2 of the lenses in the second direction satisfy a relation represented by an expression $L2/L1<1.2$. With such a configuration, it is possible to suppress a difference between the length L1 of the lenses in the first direction and the length L2 of the lenses in the second direction and easily form lenses having small astigmatism. Therefore, it is possible to simply and easily realize satisfactory exposure.

It is preferable that diaphragms are disposed between the light-emitting elements and the lenses. As explained above, in the invention, the lenses have a characteristic that the lenses can capture a large amount of light in the second direction. On the other hand, the diaphragms block a part of the light traveling from the light-emitting elements to the lenses. Therefore, from the viewpoint of effectively making use of the characteristic of the lenses, in order to suppress unnecessary blocking of the light by the diaphragms and effectively use the light from the light-emitting elements, it is preferable that a shape of the diaphragms is advantageous for leading a large amount of light into the lenses in the second direction. Therefore, it is preferable that length La1 of the diaphragms in the first direction and length La2 of the diaphragms in the second direction satisfy a relation represented by an expression $1<La2/La1$. This makes it possible to lead a larger amount of light into the lenses in the second direction and realize satisfactory exposure.

It is preferable that the length L1 of the lenses in first direction, the length L2 of the lenses in the second direction, the length La1 of the diaphragms in the first direction, and the length La2 of the diaphragms in the second direction satisfy a relation represented by an expression $L2/L1=La2/La1$. This makes it possible to effectively use the light from the light-emitting elements.

It is preferable that a shape of the lenses and a shape of the diaphragms are similar. This makes it possible to more effectively use the light from the light-emitting elements.

It is preferable that a shape of the diaphragms is elliptical.

It is preferable that surfaces of the lenses on which the light is made incident from the light-emitting elements are convex. It is preferable that the diaphragms are disposed further on an image plane side than vertexes of the lenses. This makes it possible to further improve the efficiency of use of the light from the light-emitting elements.

It is preferable that the lenses are free-form surface lenses. This is because the adoption of the free-form surface lenses improves the focusing characteristic of the lenses and makes it possible to realize more satisfactory exposure.

According to still another aspect of the invention, there is provided a line head including: a head substrate on which plural light-emitting element groups formed by grouping plural light-emitting elements are disposed; and a lens array that has a lens row in which plural lenses provided for each of the light-emitting element groups are arranged in a first direction, light from the light-emitting element group being made incident on the lenses provided with respect to the light-emitting element group, wherein, in the light-emitting element group, "n" ("n" is an integer equal to or larger than 1) light-emitting element rows, in which the plural light-emitting elements are arranged in the first direction, are arranged in a second direction orthogonal to or substantially orthogonal to the first direction, the number of the light-emitting elements arranged in the first direction of each of the light-emitting element rows is equal to or larger than "m" ("m" is an integer equal to or larger than 2 and larger than "n"), and, when the length in the first direction of the lenses is represented as L1 and the length in the second direction of the lenses is represented as L2, a relation represented by an expression L2>L1 is satisfied.

According to still another aspect of the invention, there is provided an image forming apparatus including: a line head having a head substrate on which plural light-emitting element groups formed by grouping plural light-emitting elements are disposed; and a lens array that has a lens row in which plural lenses provided for each of the light-emitting element groups are arranged in a first direction, light from the light-emitting element group being made incident on the lenses provided with respect to the light-emitting element group; and a latent image bearing member exposed by the line head, wherein, in the light-emitting element group, "n" ("n" is an integer equal to or larger than 1) light-emitting element rows, in which the plural light-emitting elements are arranged in the first direction, are arranged in a second direction orthogonal to or substantially orthogonal to the first direction, the number of the light-emitting elements arranged in the first direction of each of the light-emitting element rows is equal to or larger than "m" ("m" is an integer equal to or larger than 2 and larger than "n"), and, when the length in the first direction of the lenses is represented as L1 and the length in the second direction of the lenses is represented as L2, a relation represented by an expression L2>L1 is satisfied.

In the aspects of the invention (the line head and the image forming apparatus), the head substrate on which the plural light-emitting element groups formed by grouping the plural light-emitting elements are disposed is provided. In each of the light-emitting element groups, the "n" ("n" is an integer equal to or larger than 1) light-emitting element rows, in which the plural light-emitting elements are arranged in the first direction, are arranged in the second direction orthogonal to or substantially orthogonal to the first direction and the number of the light-emitting elements arranged in the first direction of each of the light-emitting element rows is equal to or larger than "m" ("m" is an integer equal to or larger than 2 and larger than "n"). In the lens array, the lens row in which a plurality of the lenses provided for each of the light-emitting element groups are arranged in the first direction is provided and the light from the light-emitting element group is made incident on the lenses provided with respect to the light-emitting element group. In the aspects of the invention, when the length in the first direction of the lens is represented as L1 and the length in the second direction of the lens is represented as L2, the relation represented by the expression L2>L1 is satisfied. In other words, the lens has a shape longer in the second direction than the first direction. Therefore, the lens can capture a larger amount of light in the second direction without an increase in a lens pitch of the plural lenses arranged in the first direction. Therefore, it is possible to lead a larger amount of light into the lenses even at high resolution and realize satisfactory exposure.

It is preferable that the lens array has a lens array substrate and the lenses are formed with respect to the lens array substrate. Since the lens array includes the lens array substrate and the lenses, a degree of freedom of a configuration of the lens array is improved, for example, it is possible to select different base materials for the lens array substrate and the lenses. Therefore, it is possible to appropriately design the lens array according to specifications required for the line head and more simply and easily realize satisfactory exposure by the line head.

It is preferable that the lens array substrate is formed of glass. The glass has a relatively small linear expansion coefficient. Therefore, it is possible to suppress deformation of the lens array due to a temperature change and realize satisfactory exposure regardless of temperature by forming the lens array substrate with glass.

It is preferable that the lenses are formed of photo-setting resin. The photo-curing resin sets according to irradiation of light. Therefore, it is possible to simply and easily manufacture the lens array by forming the lenses with the photo-setting resin. This makes it possible to hold down cost of the line head.

It is preferable that the lenses are free-form surface lenses. This is because the adoption of the free-form surface lenses improves the focusing characteristic of the lenses and makes it possible to realize more satisfactory exposure.

It is particularly preferable to apply the invention to a line head in which light-emitting elements are organic EL elements. When the organic EL elements are used as the light-emitting elements, an amount of light of the light-emitting elements is small compared with an amount of light emitted when LEDs or the like are used as the light-emitting elements. In particular, an amount of light is much smaller when bottom-emission organic EL elements are used as the light-emitting elements. Therefore, from the viewpoint of realizing satisfactory exposure, it is preferable to lead a larger amount of light into the lenses by applying the invention to the line head.

BRIEF DESCRIPTION OF THE DRAWINGS

The invention will be described with reference to the accompanying drawings, wherein like numbers reference like elements.

FIG. 10 is a sectional view in a longitudinal direction of the lens array, the head substrate, and the like.

FIG. 23 is a table of optical system parameters in the first example.

FIG. 24 is a table of data of the optical system in the first example shown in FIG. 21.

FIG. 25 is a diagram of a definition formula for an XY polynomial surface.

FIG. 26 is a table of coefficient values of a surface S4 of the optical system in the first example.

FIG. 27 is a table of coefficient values of a surface S7 of the optical system in the first example.

FIG. 30 is a table of optical system parameters in the second example.

FIG. 31 is a table of data of the optical system shown in FIGS. 28 and 29.

FIG. 32 is a table of coefficient values of a surface S4 of the optical system in the second example.

FIG. 33 is a table of coefficient values of a surface S7 of the optical system in the second example.

DESCRIPTION OF EXEMPLARY EMBODIMENTS

First, terms used in this specification are explained below (see a section of "A. Explanation of Terms"). Exemplary embodiments of the invention are explained following the explanation of the terms (see a section of "B. Embodiments").

A. Explanation of Terms

Figure 1:
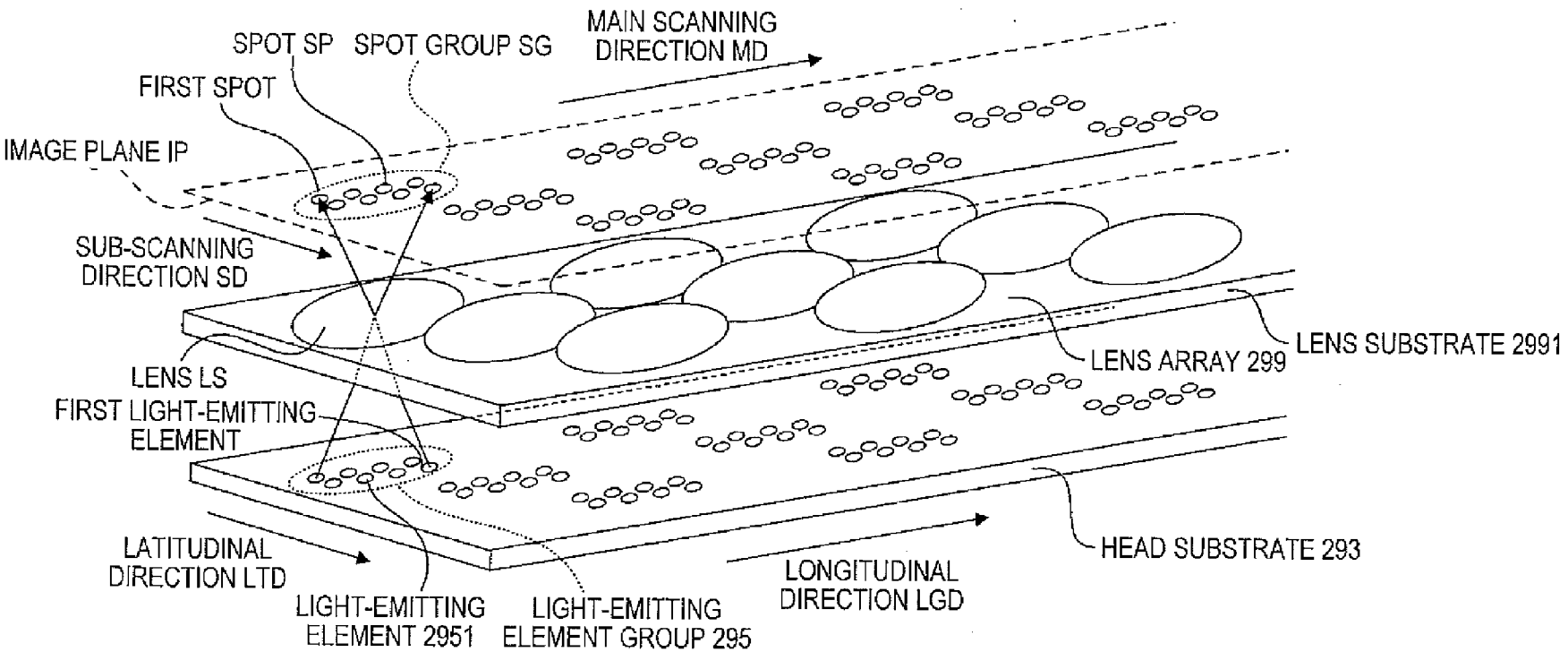
FIG. 1 is a diagram for explaining terms used in this specification.
Figure 2:
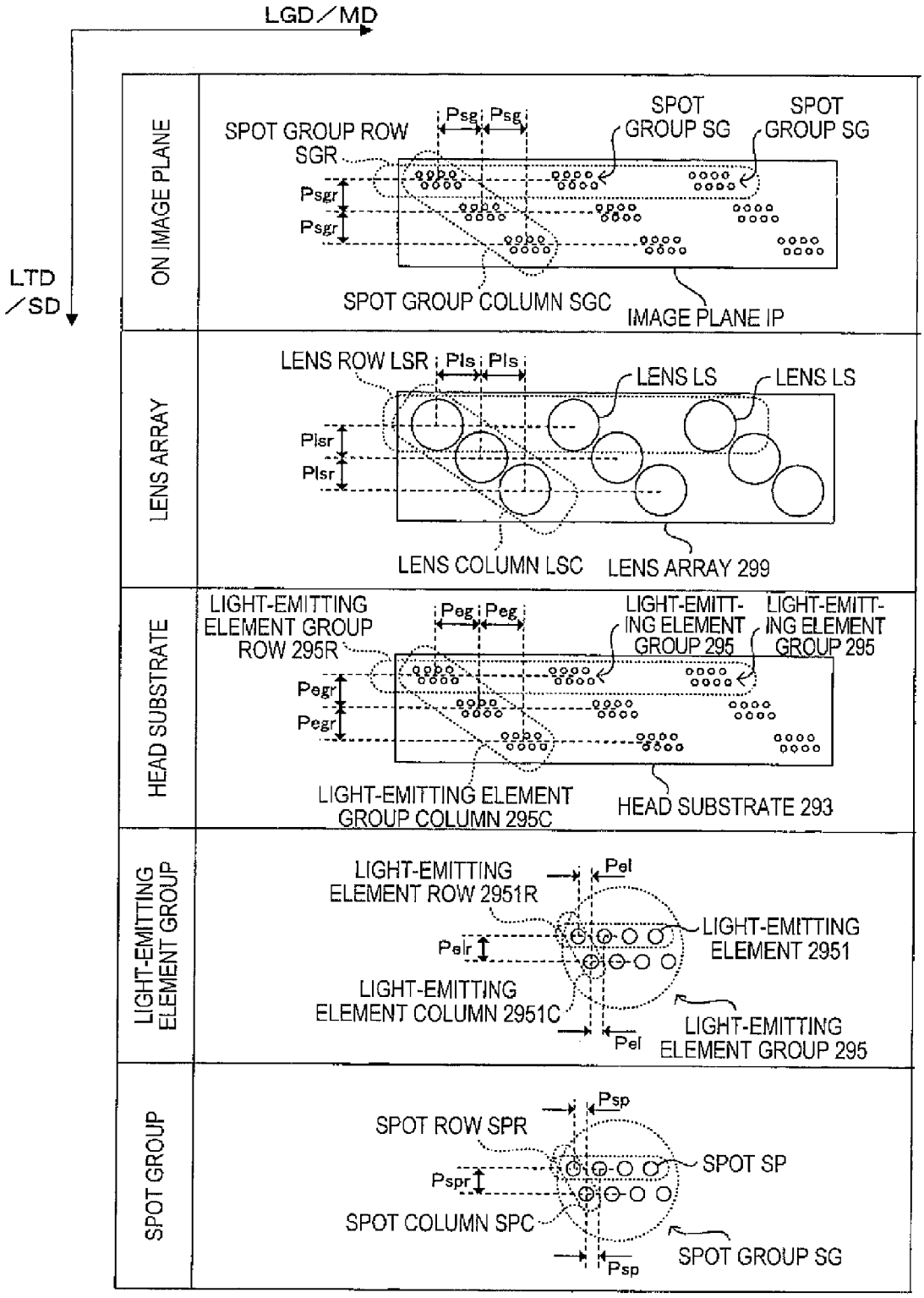
FIG. 2 is a diagram for explaining terms used in this specification.

FIGS. 1 and 2 are diagrams for explaining terms used in this specification. The terms used in this specification are organized with reference to the figures. In this specification, a conveying direction on a surface (an image plane IP) of a photoconductive drum 21 is defined as a sub-scanning direction SD and a direction orthogonal to or substantially orthogonal to the sub-scanning direction SD is defined as a main scanning direction MD. A line head 29 is arranged with respect to the surface (the image plane IP) of the photoconductive drum 21 such that a longitudinal direction LGD thereof corresponds to the main scanning direction MD and a latitudinal direction LTD thereof corresponds to the sub-scanning direction SD.

A set of plural (in FIGS. 1 and 2, eight) light-emitting elements 2951 arranged on a head substrate 293 in a one to one correspondence relation to plural lenses LS of a lens array 299 is defined as a light-emitting element group 295. On the head substrate 293, the light-emitting element group 295 including the plural light-emitting elements 2951 is arranged in a pair with each of the plural lenses LS. A set of plural spots SP formed on the image plane IP when light beams from the light-emitting element group 295 are focused by the lens LS corresponding to the light-emitting element group 295 is defined as a spot group SG. In other words, it is possible to form plural spot groups SG in one to one correspondence with plural light-emitting element groups 295. In each of the spot groups SG, in particular, a spot located most upstream in the main scanning direction MD and the sub-scanning direction SD is defined as a first spot. In particular, the light-emitting element 2951 corresponding to the first spot is defined as a first light-emitting element.

A spot group row SGR and a spot group column SGC are defined as shown in a space of "on image plane" in FIG. 2. The plural spot groups SG arranged in the main scanning direction MD are defined as the spot group row SGR. Plural spot group rows SGR are arranged side by side in the sub-scanning direction SD at a predetermined spot group row pitch Psgr. Plural (in the figure, three) spot groups SG arranged at the spot group row pitch Psgr in the sub-scanning direction SD and at a spot group pitch Psg in the main scanning direction MD are defined as the spot group column SGC. The spot group row pitch Psgr is a distance in the sub-scanning direction SD between geometric centers of gravity of two spot group rows SGR adjacent to each other in the sub-scanning direction SD. The spot group pitch Psg is a distance in the main scanning direction MD between two spot groups SG adjacent to each other in the main scanning direction MD.

A lens row LSR and a lens column LSC are defined as shown in a space of "lens array" in the figure. Plural lenses LS arranged in the longitudinal direction LGD are defined as the lens row LSR. Plural lens rows LSR are arranged side by side in the latitudinal direction LTD at a predetermined lens row pitch Plsr. Plural (in the figure, three) lenses LS arranged at the lens row pitch Plsr in the latitudinal direction LTD and at a lens pitch Pls in the longitudinal direction LGD are defined as the lens column LSC. The lens row pitch Plsr is a distance in the latitudinal direction LTD between geometric centers of gravity of two lens rows LSR adjacent to each other in the latitudinal direction LTD. The lens pitch Pls is a distance in the longitudinal direction LGD between geometric centers of gravity of two lenses LS adjacent to each other in the longitudinal direction LGD.

A light-emitting element group row 295R and a light-emitting element group column 295C are defined as shown in a space of "head substrate" in the figure. Plural light-emitting element groups 295 arranged in the longitudinal direction LGD are defined as the light-emitting element group 295R. Plural light-emitting element group rows 295R are arranged side by side in the latitudinal direction LTD at a predetermined light-emitting element group row pitch Pegr. Plural (in the figure, three) light-emitting element groups 295 arranged at the light-emitting element group row pitch Pegr in the latitudinal direction LTD and at a light-emitting element group pitch Peg in the longitudinal direction LGD are defined as the light-emitting element group column 295C. The light-emitting element group row pitch Pegr is a distance in the latitudinal direction LTD between geometric centers of gravity of two light-emitting element group rows 295R adjacent to each other in the latitudinal direction LTD. The light-emitting element group pitch Peg is a distance in the longitudinal direction LGD between geometric centers of gravity of two light-emitting element groups 295 adjacent to each other in the longitudinal direction LGD.

A light-emitting element row 2951R and a light-emitting element column 2951C are defined as shown in a space of "light-emitting element group" in the figure. In each of the light-emitting element groups 295, plural light-emitting elements 2951 arranged in the longitudinal direction LGD are defined as the light-emitting element row 2951R. Plural light-emitting element rows 2951R are arranged side by side in the latitudinal direction LTD at a predetermined light-emitting element row pitch Pelr. Plural (in the figure, two) light-emitting elements 2951 arranged at the light-emitting element row pitch Pelr in the latitudinal direction LTD and at a light-emitting element pitch Pel in the longitudinal direction LGD are defined as the light-emitting element column 2951C. The light-emitting element row pitch Pelr is a distance in the latitudinal direction LTD between geometric centers of gravity of two light-emitting element rows 2951R adjacent to each other in the latitudinal direction LTD. The light-emitting element pitch Pel is a distance in the longitudinal direction LGD between geometric centers of gravity of two light-emitting elements 2951 adjacent to each other in the longitudinal direction LGD.

A spot row SPR and a spot column SPC are defined as shown in a space of "spot group" in the figure. In each of the spot groups SG, plural spots SP arranged in the longitudinal direction LGD are defined as the spot row SPR. Plural spot rows SPR are arranged side by side in the latitudinal direction LTD at a predetermined spot row pitch Pspr. Plural (in the figure, two) spots arranged at the spot pitch Pspr in the latitudinal direction LTD and at a spot pitch Psp in the longitudinal direction LGD are defined as the spot column SPC. The spot row pitch Pspr is a distance in the sub-scanning direction SD between geometric centers of gravity of two spot rows SPR adjacent to each other in the sub-scanning direction SD. The spot pitch Psp is a distance in the longitudinal direction LGD between geometric centers of gravity of two spots SP adjacent to each other in the main scanning direction MD.

B-1. First Embodiment

Figure 3:
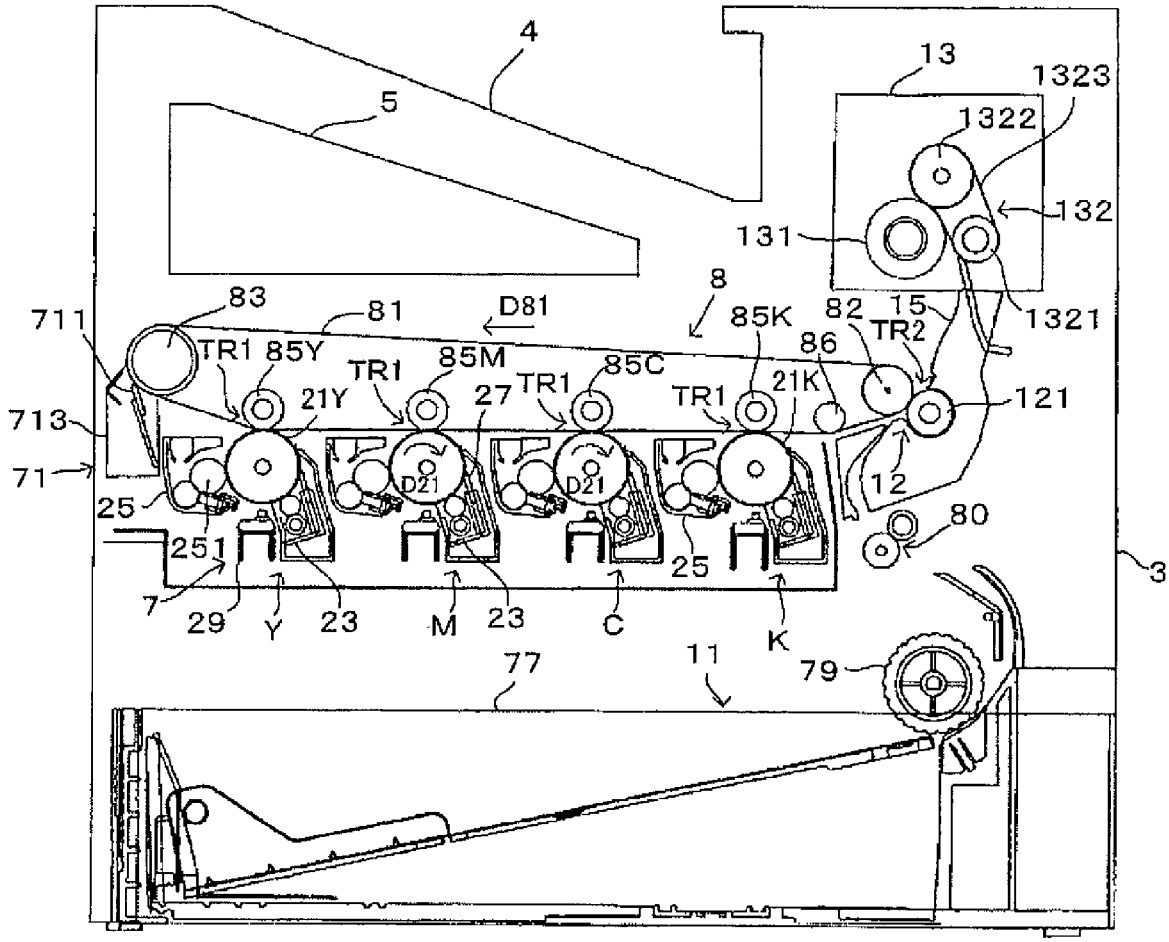
FIG. 3 is a diagram of an example of an image forming apparatus according to an embodiment of the invention.
Figure 4:
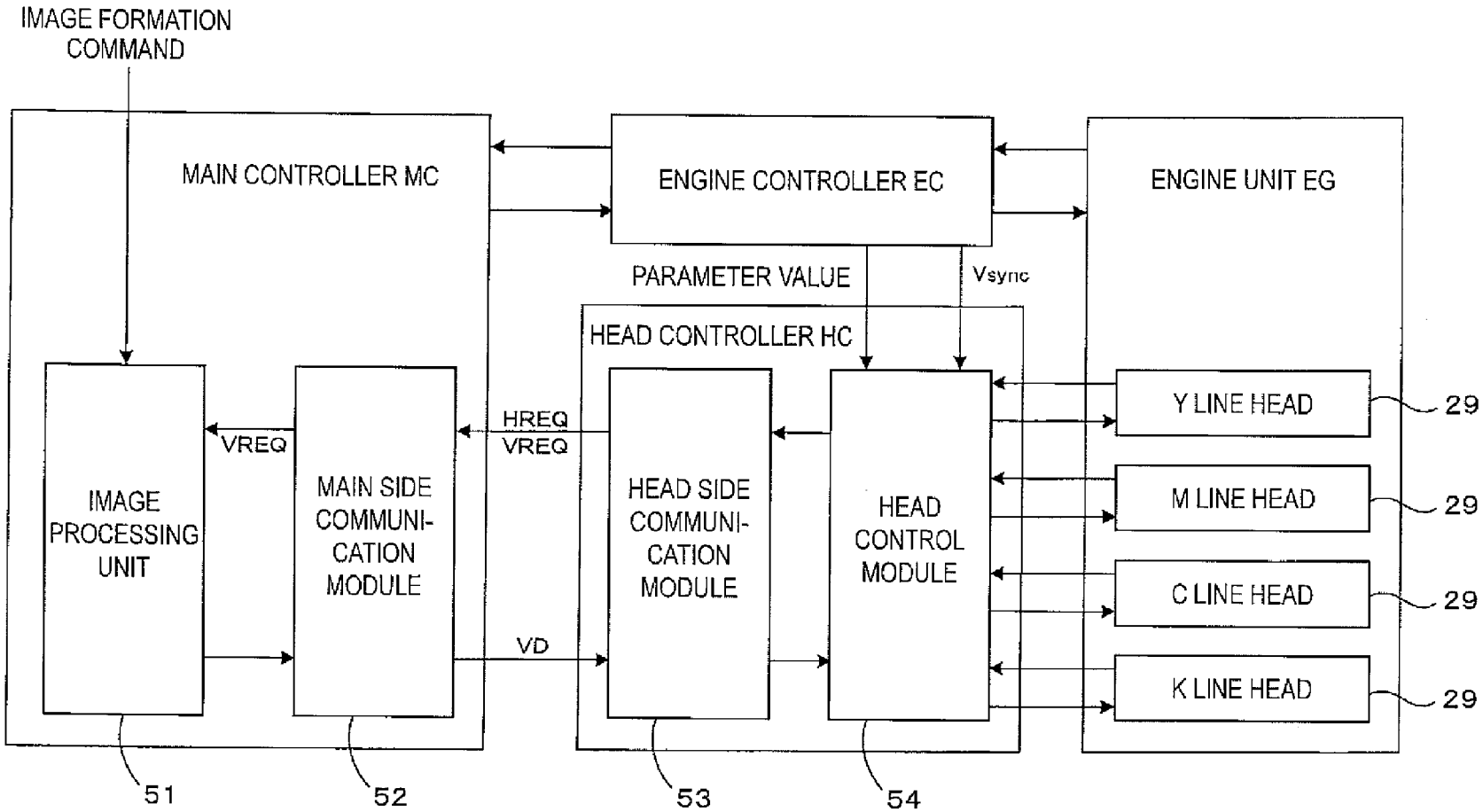
FIG. 4 is a diagram of an electric configuration of the image forming apparatus shown in FIG. 3.

FIG. 3 is a diagram of an example of an image forming apparatus including a line head according to a first embodiment of the invention. FIG. 4 is a diagram of an electric configuration of the image forming apparatus shown in FIG. 3. This apparatus is an image forming apparatus that can selectively execute a color mode for superimposing toners of four colors, black (K), cyan (C), magenta (M), and yellow (Y), one on top of another to form a color image and a monochrome mode for using only the toner of black (K) to form a monochrome image. FIG. 3 corresponds to the execution of the color mode. In the image forming apparatus, when an image formation command is given to a main controller MC having a CPU, a memory, and the like from an external apparatus such as a host computer, the main controller MC gives a control signal and the like to an engine controller EC and gives video data VD corresponding to the image formation command to a head controller HC. The head controller HC controls line heads 29 for the respective colors on the basis of the video data VD from the main controller MC and a vertical synchronization signal Vsync and a parameter value from the engine controller EC. Consequently, an engine unit EG executes a predetermined image forming operation and forms an image corresponding to the image formation command on copy paper, transfer paper, sheet paper, and a sheet such as a transparent sheet for OHP.

In a housing main body 3 of the image forming apparatus, an electric device box 5 incorporating a power supply circuit board, the main controller MC, the engine controller EC, and the head controller HC is provided. An image forming unit 7, a transfer belt unit 8, and a paper feeding unit 11 are also disposed in the housing main body 3. In FIG. 3, a secondary transfer unit 12, a fixing unit 13, and a sheet guide member 15 are disposed on the right side in the housing main body 3. The paper feeding unit 11 is detachably attachable to an apparatus main body 1. The paper feeding unit 11 and the transfer belt unit 8 can be removed to be repaired or replaced.

The image forming unit 7 includes four image forming stations Y (for yellow), M (for magenta), C (for cyan), and K (for black) that form images of plural different colors. Each of the image forming stations Y, M, C, and K includes a photoconductive drum 21 of a cylindrical shape having a surface of predetermined length in the main scanning direction MD. Each of the image forming stations Y, M, C, and K forms a toner image of a color corresponding thereto on the surface of the photoconductive drum 21. The photoconductive drum 21 is arranged such that an axial direction thereof is substantially parallel to the main scanning direction MD. The photoconductive drum 21 is connected to an exclusive driving motor and driven to rotate at predetermined speed in the direction of an arrow D21 in the figure. Consequently, the surface of the photoconductive drum 21 is conveyed in the sub-scanning direction SD orthogonal to or substantially orthogonal to the main scanning direction MD. A charging unit 23, a line head 29, a developing unit 25, and a photoconductive cleaner 27 are disposed around the photoconductive drum 21 along the rotating direction. A charging operation, a latent image forming operation, and a toner developing operation are executed by these functional units. Therefore, during execution of the color mode, toner images formed by all the image forming stations Y, M, C, and K are superimposed one on top of another on a transfer belt 81 of the transfer belt unit 8 to form a color image. During execution of the monochrome mode, only a toner image formed by the image forming station K is used to form a monochrome image. In FIG. 3, since configurations of the respective image forming stations of the image forming unit 7 are the same, for convenience of illustration, components of only a part of the image forming stations are denoted by reference numerals and signs. Reference numerals and signs for components of the other image forming stations are omitted.

The charging unit 23 includes a charging roller, the surface of which is made of elastic rubber. The charging roller comes into contact with the surface of the photoconductive drum 21 in a charging position to be driven to rotate. The charging roller is driven to rotate at circumferential speed in a driven direction with respect to the photoconductive drum 21 according to a rotating action of the photoconductive drum 21. The charging roller is connected to a charging-bias generating unit (not shown). The charging roller receives supply of a charging bias from the charging-bias generating unit and charges the surface of the photoconductive drum 21 in the charging position where the charging unit 23 and the photoconductive drum 21 come into contact with each other.

The line head 29 is arranged with respect to the photoconductive drum 21 such that a longitudinal direction thereof corresponds to the main scanning direction MD and a latitudinal direction thereof corresponds to the sub-scanning direction SD. The longitudinal direction of the line head 29 is substantially parallel to the main scanning direction MD. The line head 29 includes plural light-emitting elements arranged side by side in the longitudinal direction and is arranged apart from the photoconductive drum 21. Light is irradiated from these light-emitting elements onto the surface of the photoconductive drum 21 charged by the charging unit 23 and an electrostatic latent image is formed on the surface.

The developing unit 25 has a developing roller 251, on the surface of which a toner is born. In a developing position where the developing roller 251 and the photoconductive drum 21 come into contact with each other, a charged toner is moved from the developing roller 251 to the photoconductive drum 21 by a developing bias applied from a developing-bias generating unit (not shown), which is electrically connected to the developing roller 251, to the developing roller 251. The electrostatic latent image formed by the line head 29 is visualized.

A toner image visualized in the developing position in this way is, after being carried in the rotating direction D21 of the photoconductive drum 21, primarily transferred onto the transfer belt 81 in a primary transfer position TR1 where the transfer belt 81 and the photoconductive drums 21 come into contact with each other explained in detail later.

In this embodiment, the photoconductive cleaner 27 is provided in contact with the surface of the photoconductive drum 21 on a downstream side of the primary transfer position TR1 and an upstream side of the charging unit 23 in the rotating direction D21 of the photoconductive drum 21. The photoconductive cleaner 27 comes into contact with the photoconductive drum 21 to clean and remove a toner remaining on the surface of the photoconductive drum 21 after the primary transfer.

The transfer belt unit 8 includes a driving roller 82, a driven roller 83 (a blade counter roller) disposed on the left side of the driving roller 82 in FIG. 3, and a transfer belt 81 looped around these rollers and driven to circulate in a direction of an arrow D81 shown in the figure (a conveying direction). The transfer belt unit 8 includes, on an inner side of the transfer belt 81, four primary transfer rollers 85Y, 85M, 85C, and 85K that are arranged to be opposed, in a one to one relation, to the respective photoconductive drums 21 of the image forming stations Y, M, C, and K when a photoconductive cartridge is mounted. These primary transfer rollers 85 are electrically connected to a primary-transfer-bias generating unit (not shown). As explained in detail later, during execution of the color mode, all the primary transfer rollers 85Y, 85M, 85C, and 85K are positioned on the image forming stations Y, M, C, and K side as shown in FIG. 3. In this way, the transfer belt 81 is brought into contact with the photoconductive drums 21 of the image forming stations Y, M, C, and K to form primary transfer positions TR1 between the photoconductive drums 21 and the transfer belt 81. A primary transfer bias is applied to the primary transfer rollers 85 from the primary-transfer-bias generating unit at appropriate timing to transfer toner images formed on the surfaces of the photoconductive drums 21 onto the surface of the transfer belt 81 in the primary transfer positions TR1 respectively corresponding to the photoconductive drums 21 to form a color image.

On the other hand, during execution of the monochrome mode, the color primary transfer rollers 85Y, 85M, and 85C among the four primary transfer rollers 85 are separated from the image forming stations Y, M, and C opposed thereto and only the monochrome primary transfer roller 85K is brought into contact with the image forming station K to bring only the monochrome image forming station K into contact with the transfer belt 81. As a result, the primary transfer position TR1 is formed only between the monochrome primary transfer roller 85K and the image forming station K. A primary transfer biasis applied from the primary-transfer-bias generating unit to the monochrome primary transfer roller 85K at appropriate timing to transfer a toner image formed on the surface of the photoconductive drum 21 onto the surface of the transfer belt 81 in the primary transfer position TR1 to form a monochrome image.

The transfer belt unit 8 further includes a downstream guide roller 86 disposed on a downstream side of the monochrome primary transfer roller 85K and an upstream side of the driving roller 82. The downstream guide roller 86 comes into contact with the transfer belt 81 on a common inscribed line of the primary transfer roller 85K and the photoconductive drum 21 of the image forming station K in the primary transfer position TR1, which is formed when the monochrome primary transfer roller 85K comes into contact with the photoconductive drum 21.

The driving roller 82 drives the transfer belt 81 to circulate in the direction of the arrow D81 in the figure and also servers as a backup roller for a secondary transfer roller 121. A rubber layer having the thickness of about 3 mm and volume resistivity equal to or lower than 1000 kΩ·cm is formed on a circumferential surface of the driving roller 82. The driving roller 82 is grounded via a metal shaft to thereby form a conductive path for a secondary transfer bias supplied from a not-shown secondary-transfer-bias generating unit via the secondary transfer roller 121. The rubber layer having high friction and impact absorption is provided in the driving roller 82 in this way. Consequently, impact caused when a sheet enters a contact portion of the driving roller 82 and the secondary transfer roller 121 (a secondary transfer position TR2) is less easily transmitted to the transfer belt 81. It is possible to prevent deterioration in an image quality.

The paper feeding unit 11 includes a paper feeding cassette 77 in which sheets can be stacked and stored and a pickup roller 79 that feeds the sheets from the paper feeding cassette 77 one by one. The sheet fed from the paper feeding unit 11 by the pickup roller 79 is fed to the secondary transfer position TR2 along the sheet guide member 15 after paper feeding timing is adjusted in a registration roller pair 80.

The secondary transfer roller 121 is provided to freely separate from and come into contact with the transfer belt 81 and is driven to separate from and come into contact with the transfer belt 81 by a secondary transfer roller driving mechanism (not shown). The fixing unit 13 includes a heating roller 131 that incorporates a heating member such as a halogen heater and freely rotates and a pressing unit 132 that presses and urges the heating roller 131. The sheet having an image secondarily transferred on the surface thereof is guided by the sheet guide member 15 to a nip portion formed by the heating roller 131 and a pressing belt 1323 of the pressing unit 132. The image is thermally fixed at predetermined temperature in the nip portion. The pressing unit 132 includes two rollers 1321 and 1322 and the pressing belt 1323 looped around these rollers. A belt stretched surface stretched by the two rollers 1321 and 1322 of the surface of the pressing belt 1323 is pressed against a circumferential surface of the heating roller 131 such that the nip portion formed by the heating roller 131 and the pressing belt 1323 is secured wide. The sheet subjected to fixing processing in this way is conveyed to a paper discharge tray 4 provided in an upper surface section of the housing main body 3.

In this apparatus, a cleaner unit 71 is disposed to be opposed to the blade counter roller 83. The cleaner unit 71 includes a cleaner blade 711 and a waste toner box 713. The cleaner blade 711 brings a distal end thereof into contact with the blade counter roller 83 via the transfer belt 81 to remove foreign matters such as a toner and paper powder remaining on the transfer belt 81 after the secondary transfer. The foreign matters removed in this way are collected in a waster toner box 713. The cleaner blade 711 and the waste toner box 713 are integrated with the blade counter roller 83. Therefore, when the blade counter roller 83 moves as explained below, the cleaner blade 711 and the waste toner box 713 also move together with the blade counter roller 83.

Figure 5:
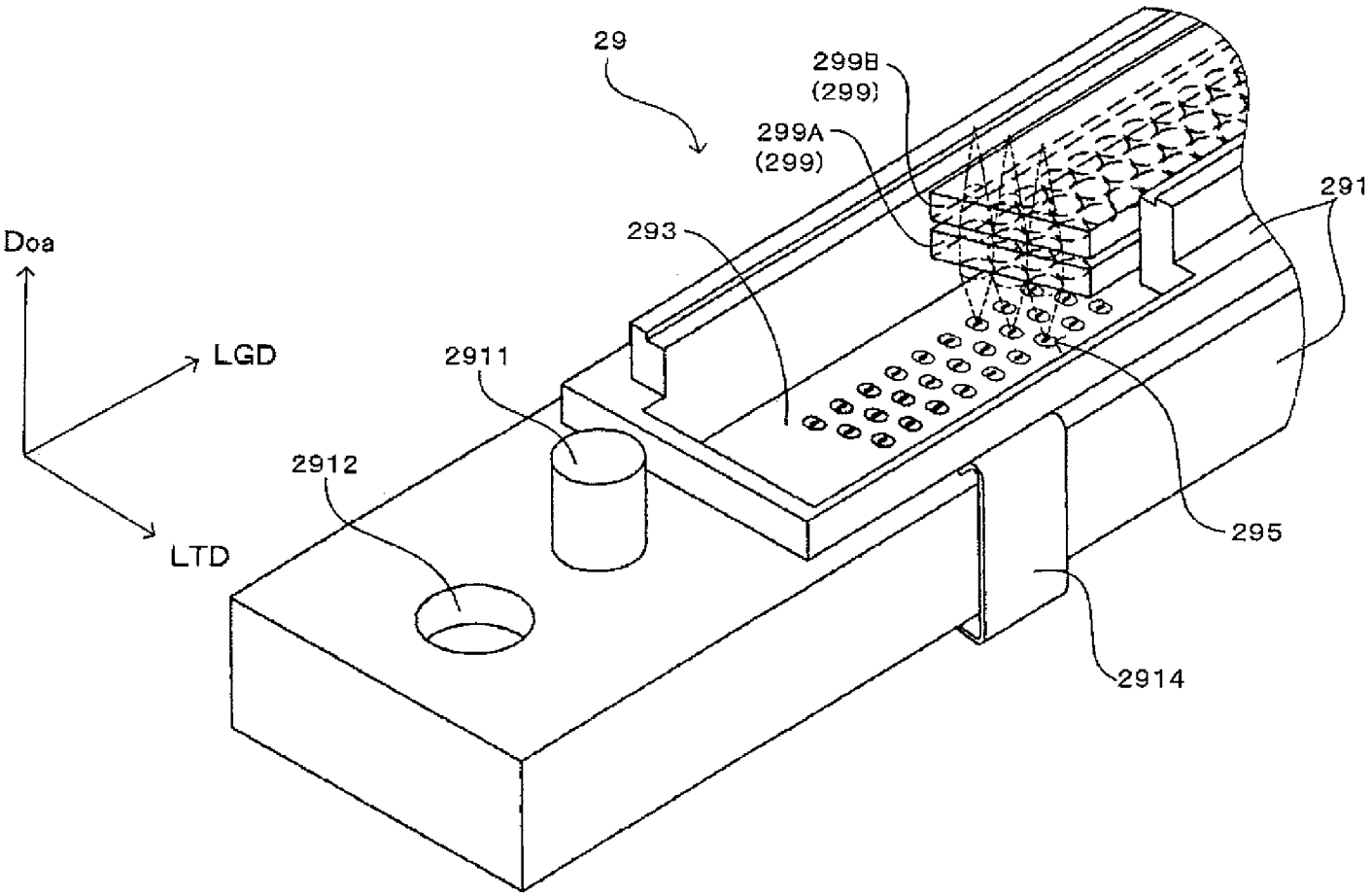
FIG. 5 is a schematic perspective view of a line head according to the embodiment.
Figure 6:
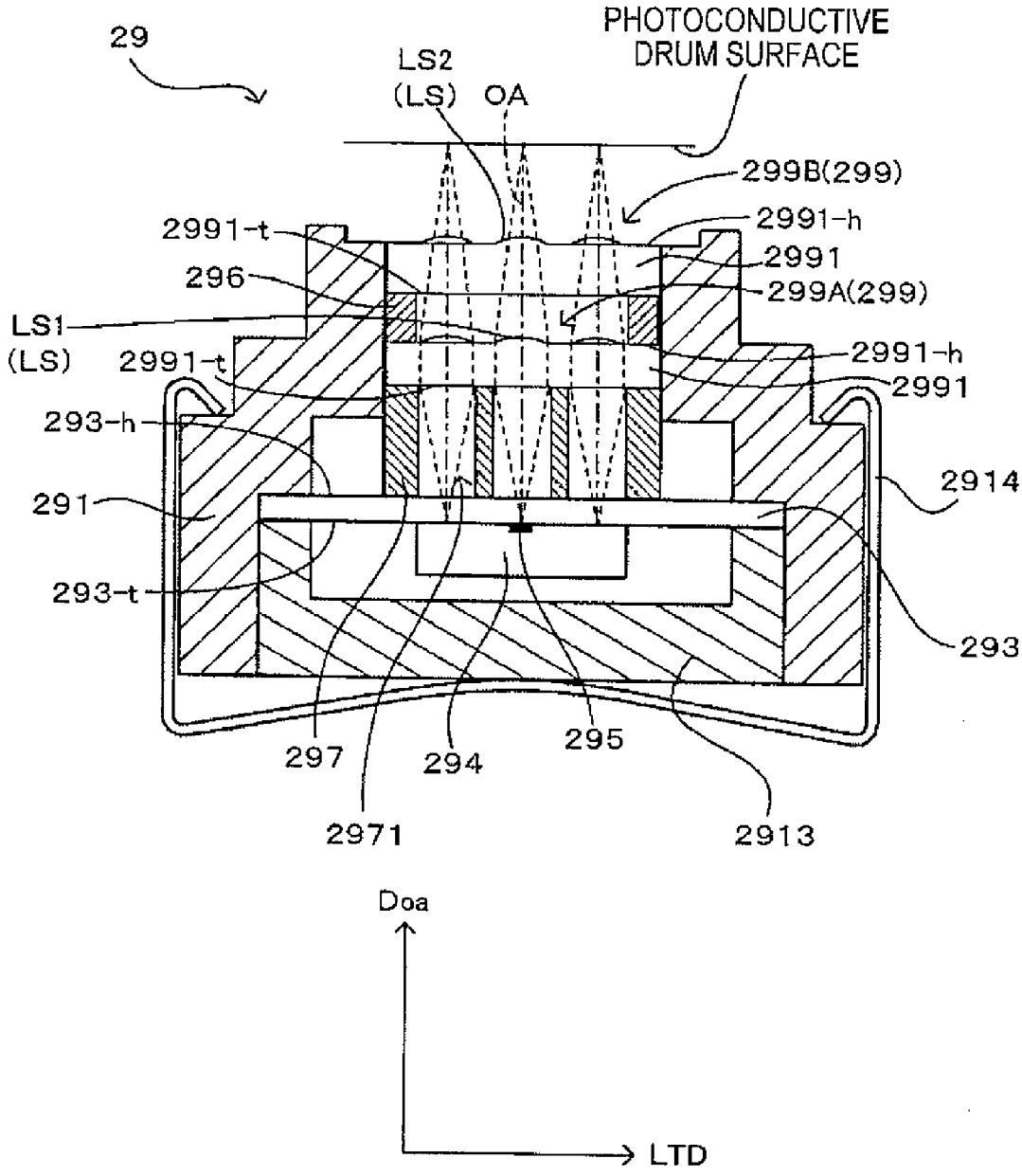
FIG. 6 is a partial sectional view in a latitudinal direction of the line head shown in FIG. 5.

FIG. 5 is a schematic perspective view of the line head according to this embodiment. FIG. 6 is a partial sectional view in a latitudinal direction of the line head shown in FIG. 5. A section parallel to optical axes of the lenses is shown in FIG. 6. As explained above, the line head 29 is arranged with respect to the photoconductive drum 21 such that the longitudinal direction LGD thereof corresponds to the main scanning direction MD and the latitudinal direction thereof corresponds to the sub-scanning direction SD. The longitudinal direction LGD and the latitudinal direction LTD are orthogonal to or substantially orthogonal to each other. As explained later, in the line head 29, plural light-emitting elements are formed on the head substrate 293. The respective light-emitting elements emit light beams to the surface of the photoconductive drum 21. Therefore, in this specification, a direction that is orthogonal to the longitudinal direction LGD and the latitudinal direction LTD and is a direction from the light-emitting elements to the surface of the photoconductive drum 21 is referred to as light beam traveling direction Doa. The light beam traveling direction Doa is parallel to or substantially parallel to an optical axis OA explained later.

The line head 29 includes a case 291. A positioning pin 2911 and a screw insertion hole 2912 are provided at both ends in the longitudinal direction LGD of the case 291. The positioning pin 2911 is fit in a positioning hole (not shown) drilled in a photoconductive cover (not shown) that covers the photoconductive drum 21 and is positioned with respect to the photoconductive drum 21, whereby the line head 29 is positioned with respect to the photoconductive drum 21. Further, a fixing screw is screwed in a screw hole (not shown) of the photoconductive cover and fixed via the screw insertion hole 2912, whereby the line head 29 is positioned and fixed with respect to the photoconductive drum 21.

The head substrate 293, a light blocking member 297, and two lens arrays 299 (299A and 299B) are arranged in the case 291. The inside of the case 291 is set in contact with a front surface 293-*h* of the head substrate 293. On the other hand, a rear cap 2913 is set in contact with a rear surface 293-*t* of the head substrate 293. The rear cap 2913 is pressed against the inside of the case 291 by fixing instruments 2914 via the head substrate 293. The fixing instruments 2914 have elastic force for pressing the rear cap 2913 against the inner side of the case 291 (the upper side in FIG. 6). Since the rear cap 2913 is pressed by such elastic force, the inside of the case 291 is sealed in a light-tight manner (i.e., to prevent light from leaking from the inside of the case 291 and prevent light from entering from the outside of the case 291). The fixing instruments 2914 are provided in plural places in the longitudinal direction LGD of the case 291.

The light-emitting element group 295 formed by grouping plural light-emitting elements is provided on the rear surface 293-*t* of the head substrate 293. The head substrate 293 is formed of a light transmissive member such as glass. Light beams emitted by the respective light-emitting elements of the light-emitting element group 295 can penetrate from the rear surface 293-*t* to the front surface 293-*h* of the head substrate 293. The light-emitting elements are bottom-emission organic EL (Electro-Luminescence) elements and are covered with a sealing member 294. Details of the arrangement of the light-emitting elements on the rear surface 293-*t* of the head substrate 293 are as explained below.

Figure 7:
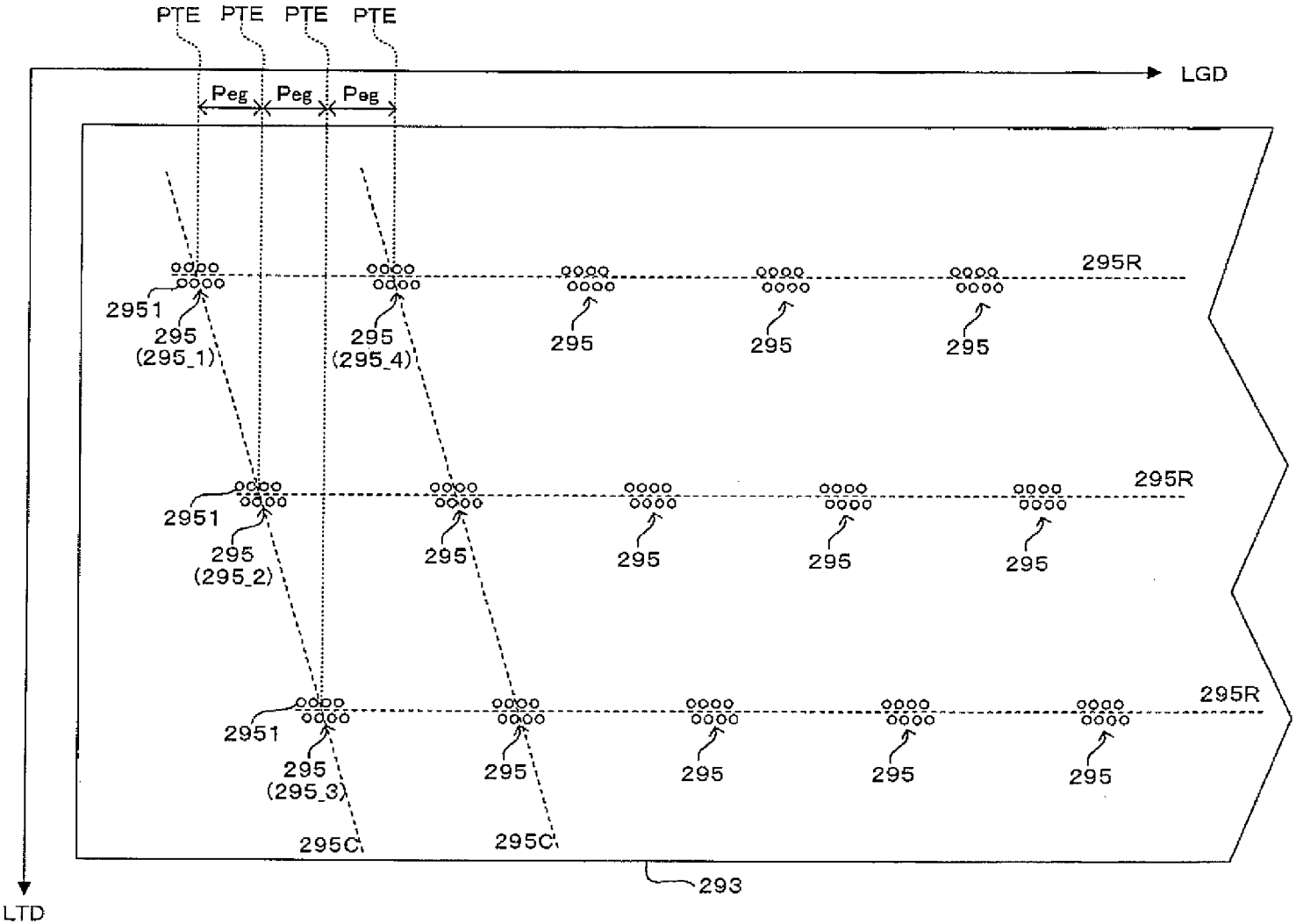
FIG. 7 is a diagram of a configuration of a rear surface of a head substrate.
Figure 8:
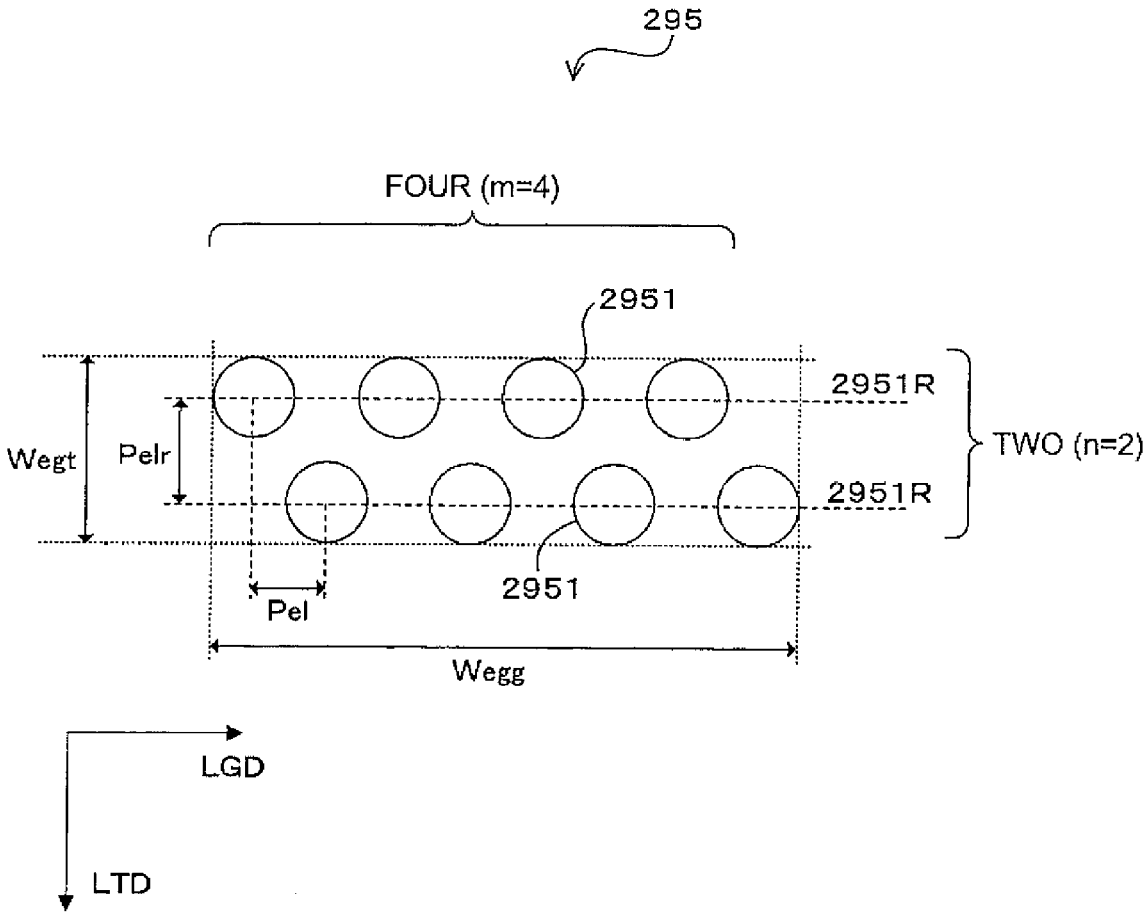
FIG. 8 is a diagram of a configuration of light-emitting element groups provided on the rear surface of the head substrate.

FIG. 7 is a diagram of a configuration of the rear surface of the head substrate. In FIG. 7, the rear surface is viewed from the front surface of the head substrate. FIG. 8 is a diagram of a configuration of light-emitting element groups provided on the rear surface of the head substrate. As shown in FIG. 7, each of the light-emitting element groups 295 is formed by grouping the eight light-emitting elements 2951. In the light-emitting element group 295, the eight light-emitting elements 2951 are arranged as explained below. As shown in FIG. 8, in the light-emitting element group 295, the light-emitting element row 2951R is formed by arranging a quartet of the light-emitting elements 2951 along the longitudinal direction LGD. Two light-emitting element rows 2951R are provided side by side at the light-emitting element row pitch Pelr in the latitudinal direction LTD. The respective light-emitting element rows 2951R are shifted from each other by the light-emitting element pitch Pel in the longitudinal direction LGD. Positions of the respective light-emitting elements 2951 in the longitudinal direction LGD are different from one another. The light-emitting element group 295 configured in this way has longitudinal direction width Wegg in the longitudinal direction LGD and has latitudinal direction width Wegt in the latitudinal direction LTD. The longitudinal direction width Wegg is larger than the latitudinal direction width Wegt. As explained above, in this embodiment, the number of the light-emitting elements 2951 arranged in the longitudinal direction LGD in each of the light-emitting element rows 2951R is "m" (=4). The number of the light-emitting element rows 2951R arranged in the latitudinal direction LTD in the light-emitting element group 295 is "n" (=2).

A plurality of the light-emitting element groups 295 configured as explained above are arranged on the rear surface 293-*t* of the head substrate 293. Three light-emitting element groups 295 are arranged in positions different from one another in the latitudinal direction LTD to form the light-emitting element group column 295C. Plural light-emitting element group columns 295C are arranged along the longitudinal direction LGD. In each of the light-emitting element group columns 295C, the three light-emitting element groups 295 are arranged to be shifted from one another by the light-emitting element group pitch Peg in the longitudinal direction LGD. As a result, positions PTE in the longitudinal direction LGD of the respective light-emitting element groups 295 are different from one another. In other words, the light-emitting element group row 295R is formed by arranging the plural light-emitting element groups 295 in the longitudinal direction LGD on the rear surface 293-*t* of the head substrate 293. Three light-emitting element group rows 295R are provided in the latitudinal direction LTD. The respective light-emitting element group rows 295R are arranged to be shifted from one another by the light-emitting element group pitch Peg in the longitudinal direction LGD. As a result, the positions PTE in the longitudinal direction LGD of the respective light-emitting element group 295 are different from one another. In this way, in this embodiment, the plural light-emitting element groups 295 are two-dimensionally arranged on the head substrate 293. In the figure, the positions of the light-emitting element groups 295 are represented by center of gravity positions of the light-emitting element groups 295. The positions PTE in the longitudinal direction LGD of the light-emitting element groups 295 are represented by feet of perpendiculars extended from the positions of the light-emitting element groups 295 in the longitudinal direction LGD.

The respective light-emitting elements 2951 formed on the head substrate 293 in this way receive driving force from, for example, a TFT (Thin Film Transistor) circuit and emit light beams of waveforms equal to one another. Light-emitting surfaces of the light-emitting elements 2951 are so-called perfect diffuser light sources. Light beams emitted from the light-emitting surfaces conform to the Lambert cosine low.

Referring back to FIGS. 5 and 6, the light blocking member 297 is arranged in contact with the surface 293-*h* of the head substrate 293. In the light blocking member 297, a light guide hole 2971 is provided for each plurality of light-emitting element groups 295 (i.e., plural light guide holes 2971 are provided in a one to one relation with respect to the plural light-emitting element groups 295). The respective light guide holes 2971 are formed in the light blocking member 297 as holes piercing through the light blocking member 297 in the light beam traveling direction Doa. On an upper side of the light blocking member 297 (the opposite side of the head substrate 293), two lens arrays 299 are arranged side by side in the light beam traveling direction Doa.

As explained above, in the light beam traveling direction Doa, the light blocking member 297 in which the light guide hole 2971 is provided for each of the light-emitting element groups 295 is arranged between the light-emitting element groups 295 and the lens arrays 299. Therefore, the light beams emitted from the light-emitting element group 295 pass through the light guide hole 2971 corresponding to the light-emitting element group 295 and travel to the lens arrays 299. Conversely, among the light beams emitted from the light-emitting element group 295, the light beams traveling to places other than the light guide hole 2971 corresponding to the light-emitting element group 295 are blocked by the light blocking member 297. In this way, all the light beams emitted from one light-emitting element group 295 travel to the lens arrays 299 via the same light guide hole 2971. Interference of the light beams emitted from the different light-emitting element groups 295 is prevented by the light blocking member 297.

Figure 9:
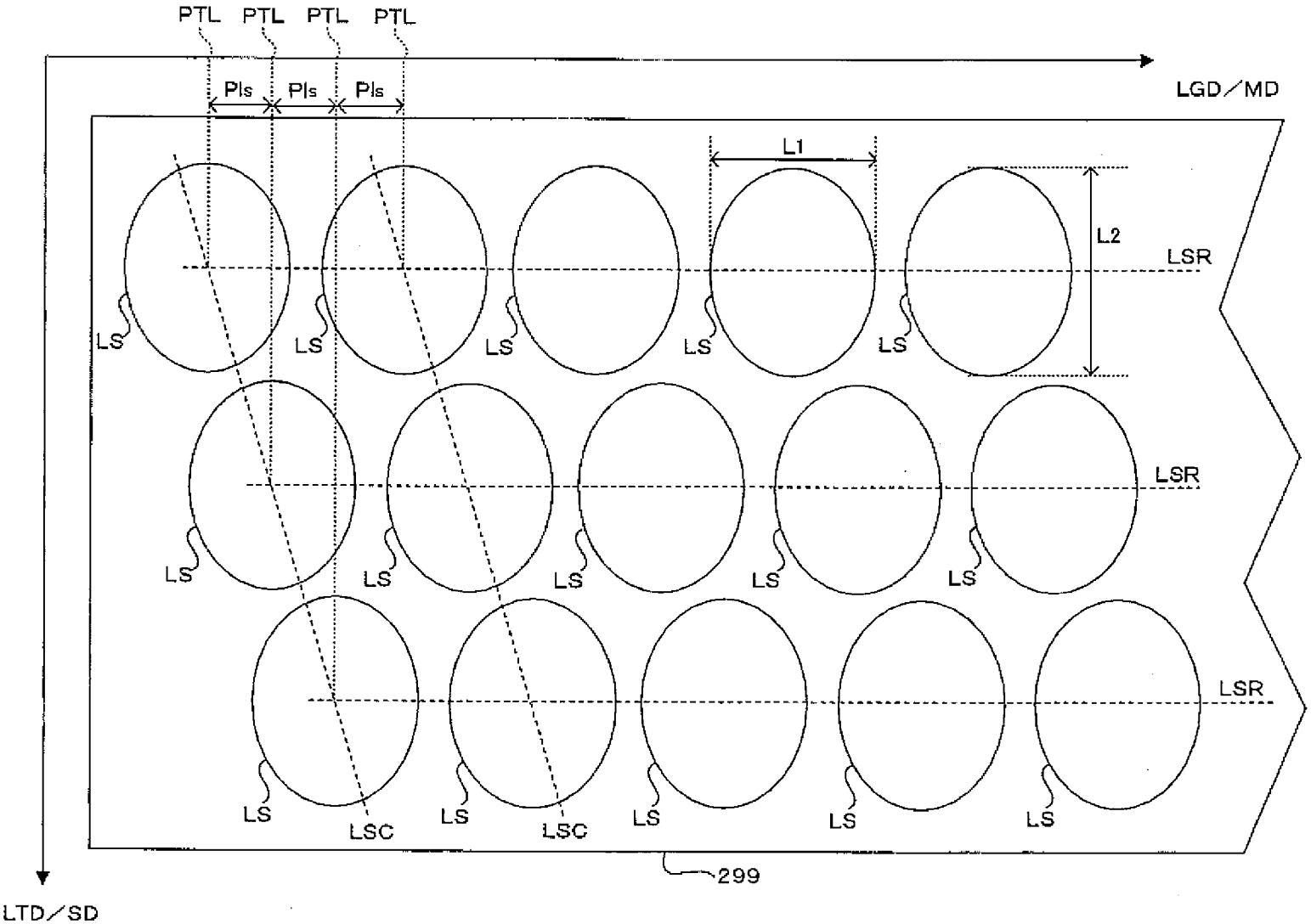
FIG. 9 is a plan view of a lens array according to the embodiment.

FIG. 9 is a plan view of the lens array according to this embodiment. In FIG. 9, the lens array is viewed from the image plane side (light beam traveling direction Doa side). The lenses LS in the figure are formed on a surface 2991-*h* of a lens array substrate 2991. A configuration of the lens array substrate surface 2991-*h* is shown in the figure. In the lens array 299, the lens LS is provided for each of the light-emitting element groups 295. In the lens array 299, three lenses LS are arranged in different positions in the latitudinal direction LTD to form the lens column LSC. Plural lens columns LSC are arranged along the longitudinal direction LTD. In each of the lens columns LSC, the three lenses LS are arranged to be shifted from one another by the lens pitch Pls in the longitudinal direction LGD. As a result, positions PTL in the longitudinal direction LGD of the respective lenses LS are different from one another. In other words, in the lens array 299, the plural lenses LS are arranged in the longitudinal direction LGD to form the lens row LSR. Three lens rows LSR are provided in the latitudinal direction LTD. The respective lens rows LSR are arranged to be shifted from one another by the lens pitch Pls in the longitudinal direction LGD. The positions PTL in the longitudinal direction LGD of the respective lenses LS are different from one another. In this way, the plural lenses LS are two-dimensionally arranged in the lens array 299. In the figure, the positions of the lenses LS are represented by vertexes of the lenses LS (i.e., points where sag is maximized) The positions PTL in the longitudinal direction LGD of the lenses LS are represented by feet of perpendiculars extended from the vertexes of the lenses LS in the longitudinal direction LGD.

As shown in FIG. 9, in this embodiment, the lenses LS have an elliptical shape long in the latitudinal direction LTD. When the length in the longitudinal direction LGD of the lenses LS is represented as lens longitudinal direction length L1 and the length in the latitudinal direction LTD of the lenses LS is represented as lens latitudinal direction length L2, the lenses LS are configured such that a relation represented by L2>L1 is satisfied. A shape of the light guide holes 2971 of the light blocking member 297 is also formed in an elliptical shape long in the latitudinal direction LTD according to the shape of the lenses LS.

Figure 10:
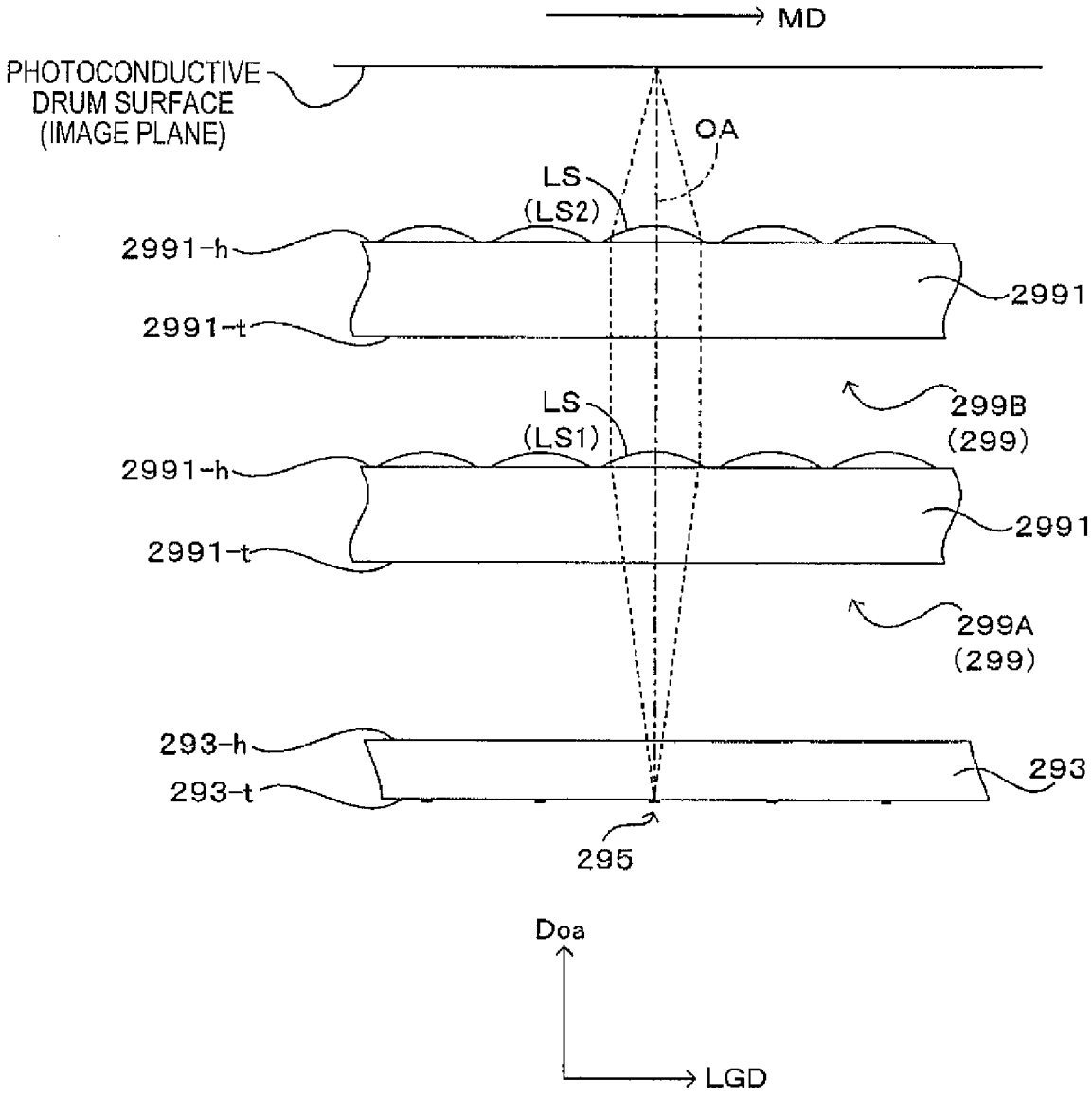

FIG. 10 is a sectional view in a longitudinal direction of the lens array, the head substrate, and the like. A longitudinal direction section including optical axes of the lenses LS formed in the lens array is shown in the figure. The lens array 299 has the light transmissive lens array substrate 2991. In this embodiment, the lens array 2991 is formed of glass having relatively small linear expansion coefficient. The lenses LS are formed on the front surface 2991-*h* of the front surface 2991-*h* and the rear surface 2991-*t* of the lens array substrate 2991. The lens array 299 is formed by a method disclosed in, for example, JP-A-2005-276849. A die having recesses corresponding to a shape of the lenses LS is brought into contact with a glass substrate serving as the lens array substrate 2991. Photo-setting resin is filled between the die and a light transmissive substrate. When light is irradiated on the photo-setting resin, the photo-setting resin sets and the lenses LS are formed on the light transmissive substrate. When the photo-setting resin sets and the lenses LS are formed, the die is released.

As explained above, in this embodiment, the lens array 299 includes the lens array substrate 2991 and the lenses LS. Therefore, a degree of freedom of a configuration of the lens array 299 is improved, for example, different base materials can be selected for the lens array substrate 2991 and the lenses LS. Therefore, it is possible to appropriately design the lens array 299 according to specifications required for the line head 29 and more simply and easily realize satisfactory exposure by the line head 29. In this embodiment, the lenses LS are formed of the photo-setting resin that can be caused to quickly set according to irradiation of light. Therefore, since the lenses LS can be simply and easily formed, it is possible to simplify a manufacturing processing for the lens array 299 and reduce cost of the lens array 299. Further, since the lens array substrate 2991 is formed of the glass having small linear expansion coefficient, deformation of the lens array 299 due to a temperature change is suppressed. It is possible to realize satisfactory exposure regardless of temperature.

In the line head 29, two lens arrays 299 (299A and 299B) having such a configuration are arranged side by side in the light beam traveling direction Doa. The two lens arrays 299A and 299B are opposed to each other across a pedestal 296. The pedestal 296 plays a function of specifying a space between the lens arrays 299A and 299B. In this way, in this embodiment, two first and second lenses LS1 and LS2 arranged in the light beam traveling direction Doa are arranged for each of the light-emitting element groups 295 (see FIGS. 5, 6, and 10). Optical axes OA (indicated by an alternate long and two short dashes line in FIG. 10) respectively passing the centers of the first lens LS1 and the second lens LS2 corresponding to the same light-emitting element group 295 are orthogonal to or substantially orthogonal to the rear surface 293-*t* of the head substrate 293. The lens LS of the lens array 299A on an upstream side in the light beam traveling direction Doa is the first lens LS1. The lens LS of the lens array 299B on a downstream side in the light beam traveling direction Doa is the second lens LS2. In this embodiment, since the plural lens arrays 299 are arranged side by side in the light beam traveling direction Doa, it is possible to improve a degree of freedom of optical design.

As explained above, the line head 29 includes a focusing optical system including the first and second lenses LS1 and LS2. Therefore, the light beams emitted from the light-emitting element group 295 are focused by the first lens LS1 and the second lens LS2 and a spot SP is formed on the photoconductive drum surface (the image plane). On the other hand, as explained above, the photoconductive drum surface is charged by the charging unit 23 prior to spot formation. Therefore, a region where the spot SP is formed is subjected to charge removal and a spot latent image Lsp is formed in the region. The spot latent image Lsp formed in this way is carried to a downstream side in the sub-scanning direction SD while being born on the photoconductive drum surface. As explained below, the spot SP is formed at timing corresponding to the movement of the photoconductive drum surface and plural latent images Lsp arranged in the main scanning direction MD are formed.

Figure 11:
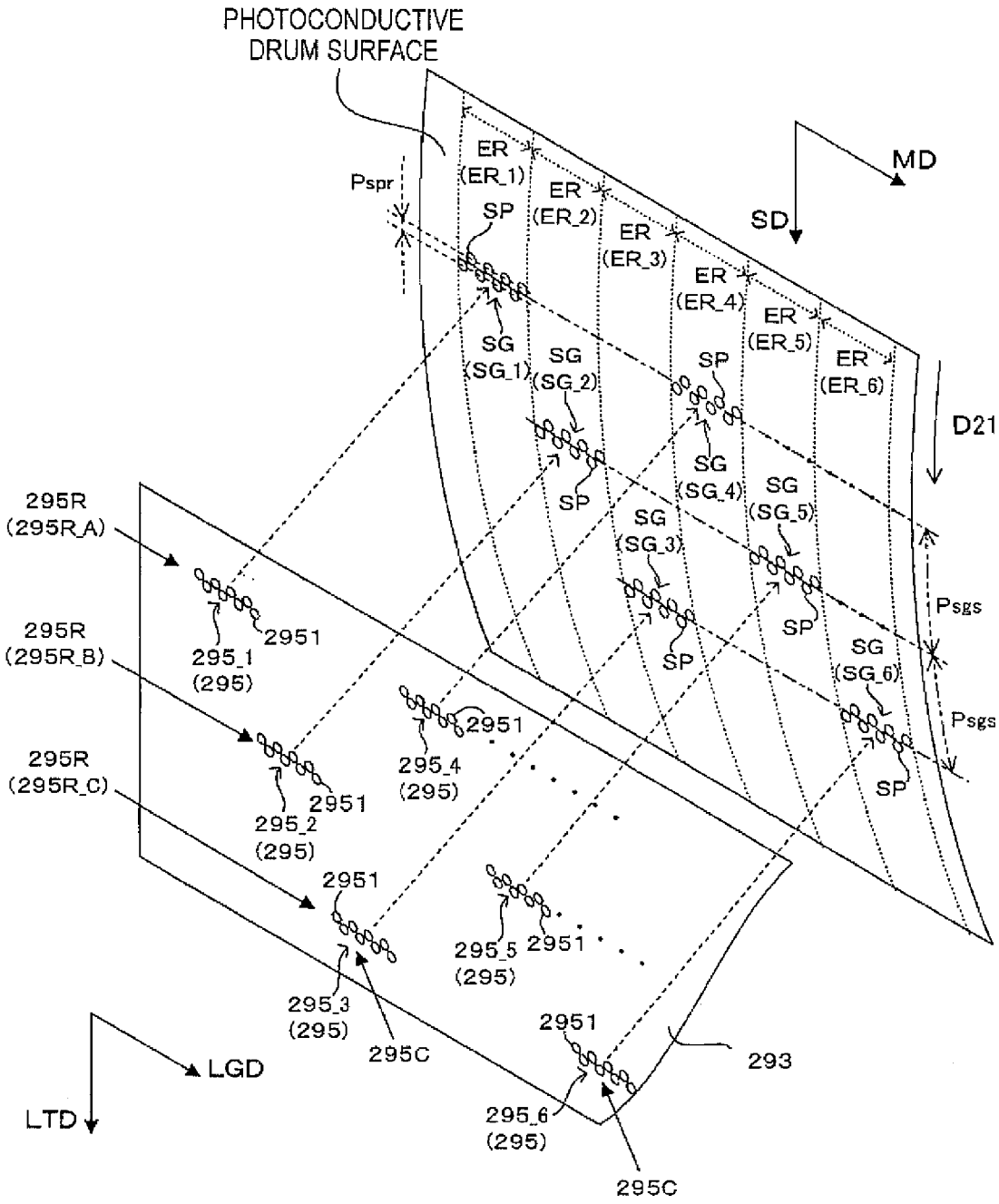
FIG. 11 is a perspective view for explaining spots formed by the line head.

FIG. 11 is a perspective view for explaining spots formed by the line head. In FIG. 11, the lens array 299 is not shown. As shown in FIG. 11, the respective light-emitting element groups 295 can form spot groups SG in exposure regions ER different from one another in the main scanning direction MD. The spot groups SG are sets of plural spots SP formed by all the light-emitting elements 2951 of the light-emitting element groups 295 simultaneously emitting lights. As shown in the figure, three light-emitting element groups 295 that can form the spot groups SG in the exposure regions ER continuous in the main scanning direction MD are arranged to be shifted from one another in the latitudinal direction LTD. For example, three light-emitting element groups 295_1, 295_2, and 295_3 that can form spot groups SG_1, SG_2, and SG_3 in exposure regions ER_1, ER_2, and ER_3 continuous in the main scanning direction MD are arranged from one another in the latitudinal direction LTD. These three light-emitting element groups 295 configure the light-emitting element group column 295C. Plural light-emitting element group columns 295C are arranged along the longitudinal direction LGD. As a result, as explained with reference to FIG. 7, three light-emitting element group rows 295R_A, 295R_B, and 295R_C are arranged in the latitudinal direction LTD and form the spot groups SG in positions different from one another in the sub-scanning direction SD.

In the line head 29, the plural light-emitting element groups 295 (e.g., the light-emitting element groups 295_1, 295_2, and 295_3) are arranged in positions different from one another in the latitudinal direction LTD. The respective light-emitting element groups 295 arranged in the positions different from one another in the latitudinal direction LTD form the spot groups SG (e.g., the spot groups SG_1, SG_2, and SG_3) in positions different from one another in the sub-scanning direction SD.

In other words, in the line head 29, plural light-emitting elements 2951 are arranged in positions different from one another in the latitudinal direction LTD (e.g., the light-emitting elements 2951 belonging to the light-emitting element group 295_1 and the light-emitting elements 2951 belonging to the light-emitting element group 295_2 are arranged in positions different from each other in the latitudinal direction LTD). The respective light-emitting elements 2951 arranged in the positions different from one another in the latitudinal direction LTD form the spots SP in positions different from one another in the sub-scanning direction SD (e.g., the spots SP belonging to the spot group SG_1 and the spots SP belonging to the spot group SG_2 are formed in positions different from each other in the sub-scanning direction SD).

As explained above, forming positions of the spots SP in the sub-scanning direction SD are different depending on the light-emitting elements 2951. Therefore, in order to form plural spot latent images Lsp side by side in the main scanning direction MD (i.e., in order to form plural spot latent images Lsp in the same position in the sub-scanning direction SD), it is necessary to take into account such a difference in the spot forming positions. Therefore, in the line head 29, the respective light-emitting elements 2951 emit lights at timing corresponding to the movement of the photoconductive drum surface.

Figure 12:
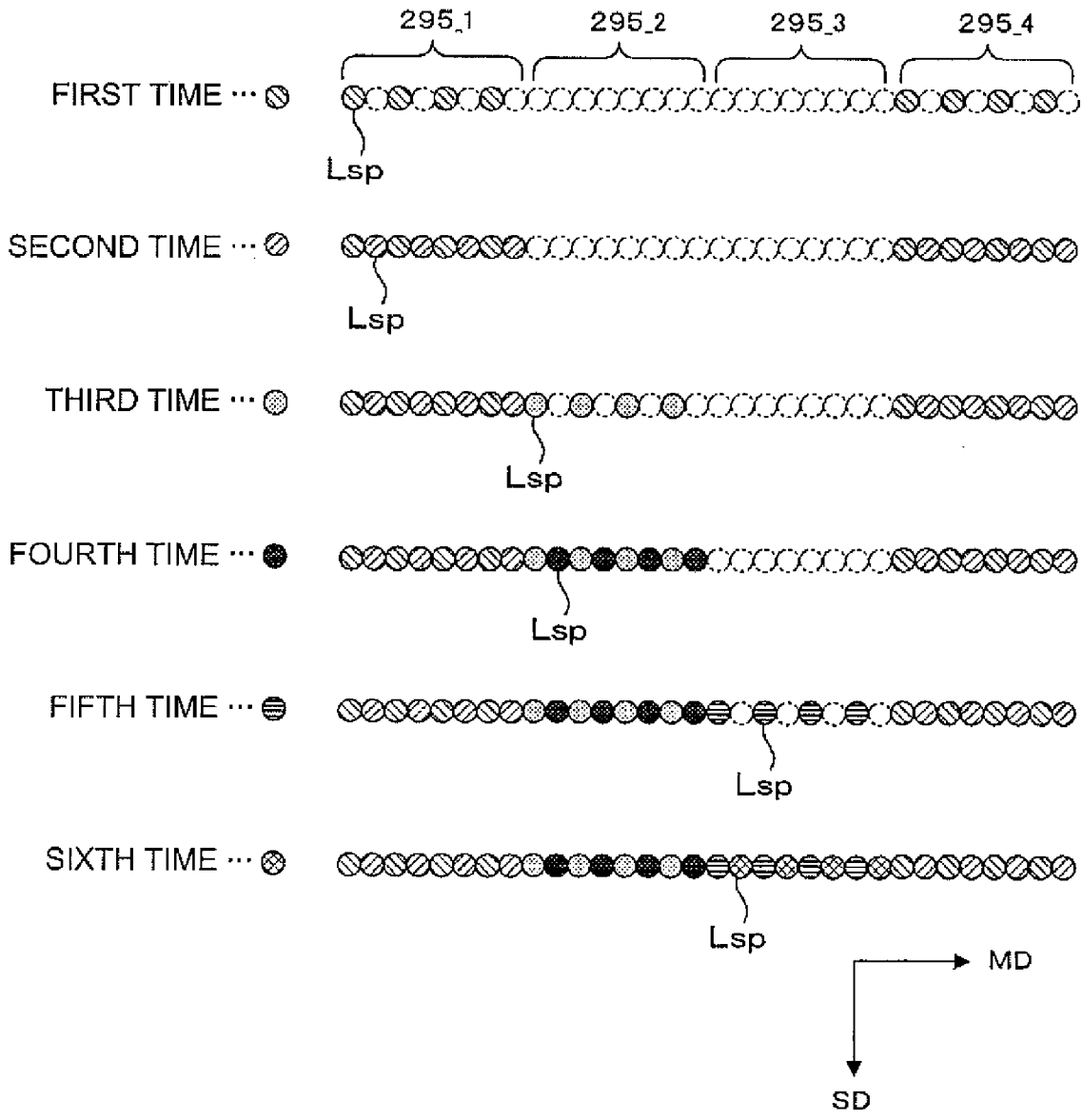
FIG. 12 is a diagram for explaining a spot forming operation by the line head.

FIG. 12 is a diagram for explaining a spot forming operation by the line head explained above. The spot forming operation by the line head is explained below with reference to FIGS. 7, 11, and 12. Schematically, the photoconductive drum surface (a latent image bearing member surface) moves in the sub-scanning direction SD and a head control module 54 (FIG. 4) causes the light-emitting elements 2951 to emit light at timing corresponding to the movement of the photoconductive drum surface, whereby plural spot latent images Lsp arranged in the main scanning direction MD are formed.

First, among the light-emitting element rows 2951R (FIG. 11) belonging to the light-emitting element groups 295_1, 295_4, and the like most upstream in the latitudinal direction LTD, the head control module 54 causes the light-emitting element rows 2951R on a downstream side in the latitudinal direction LTD to emit light. Plural light beams emitted•by such a light-emitting operation are focused by the lenses LS and the spots SP are formed on the photoconductive drum surface. The lenses LS have an inversion characteristic. The light beams from the light-emitting elements 2951 are focused in an inverted state. In this way, the spot latent images Lsp are formed in positions of a hatching pattern in "first time" shown in FIG. 12. In the figure, white void circles represent spot latent images that are not formed yet and are planned to be formed in future. In the figure, it is indicated that spot latent images denoted by reference numerals 295_1 to 295_4 are respectively spot latent images formed by the light-emitting element groups 295 corresponding to the reference signs affixed thereto.

Subsequently, among the light-emitting element rows 2951R belonging to the light-emitting element groups 295_1, 295_4, and the like, the head control module 54 causes the light-emitting element rows 2951R on an upstream side in the latitudinal direction LTD to emit light. Plural beams emitted by such a light-emitting operation are focused by the lenses LS and the spots SP are formed on the photoconductive drum surface. In this way, the spot latent images Lsp are formed in positions of a hatching pattern in "second time" shown in FIG. 12. The head control module 54 causes the light-emitting element rows 2951R to emit light in order from the light-emitting element rows 2951R on the downstream side in the latitudinal direction LTD because the lenses LS have the inversion characteristic.

Among the light-emitting element rows 2951R belonging to the light-emitting element groups 295_2 and the like second from the upstream side in the latitudinal direction LTD, the head control module 54 causes the light-emitting element rows 2951R on the downstream side in the latitudinal direction LTD to emit light. Plural light beams emitted by such a light-emitting operation are focused by the lenses LS and the spots SP are formed on the photoconductive drum surface. In this way, the spot latent images Lsp are formed in positions of a hatching pattern in "third time" shown in FIG. 12.

Among the light-emitting element rows 2951R belonging to the light-emitting element groups 295_2 and the like second from the upstream side in the latitudinal direction LTD, the head control module 54 causes the light-emitting element rows 2951R on the upstream side in the latitudinal direction LTD to emit light. Plural light beams emitted by such a light-emitting operation are focused by the lenses LS and the spots SP are formed on the photoconductive drum surface. In this way, the spot latent images Lsp are formed in positions of a hatching pattern in "fourth time" shown in FIG. 12.

Among the light-emitting element rows 2951R belonging to the light-emitting element groups 295_3 and the like third from the upstream side in the latitudinal direction LTD, the head control module 54 causes the light-emitting element rows 2951R on the downstream side in the latitudinal direction LTD to emit light. Plural light beams emitted by such a light-emitting operation are focused by the lenses LS and the spots SP are formed on the photoconductive drum surface. In this way, the spot latent images Lsp are formed in positions of a hatching pattern in "fifth time" shown in FIG. 12.

Finally, among the light-emitting element rows 2951R belonging to the light-emitting element group 295_3 third from the upstream side in the latitudinal direction LTD, the head control module 54 causes the light-emitting element row 2951R on the upstream side in the latitudinal direction LTD to emit light. Plural light beams emitted by such a light-emitting operation are focused by the lenses LS and the spots SP are formed on the photoconductive drum surface In this way, the spot latent images Lsp are formed in positions of a hatching pattern in "sixth time" shown in FIG. 12. As explained above, according to the execution of the first to sixth light-emitting operations, the spots SP are formed in order from the spot SP on the upstream side in the sub-scanning direction SD and plural spot latent images Lsp arranged in the main scanning direction MD are formed.

As explained above, in this embodiment, the respective lenses LS are configured such that the lens longitudinal direction length L1 and the length latitudinal direction length L2 satisfy the relation represented by the expression L2>L1. In other words, the lens LS has a shape longer in the latitudinal direction LTD (the second direction) than the longitudinal direction LGD (the first direction). Therefore, the lens LS can capture a larger amount of light in the latitudinal direction LTD without an increase in the lens pitch Pls of the lenses LS arranged in the longitudinal direction LGD. Therefore, it is possible to lead a large amount of light into the lens LS even at high resolution and realize satisfactory exposure.

In this embodiment, the organic EL elements are used as the light-emitting elements 2951. Since the organic EL elements have a small amount of light compared with LEDs (Light-emitting Diodes) and the like, an amount of light that can be led into the lenses LS tends decrease. In particular, when the bottom-emission organic EL elements are used, since a part of light beams emitted from the organic EL elements are absorbed by the head substrate 293, the amount of light that can be led into the lenses LS further decreases. On the other hand, in this embodiment, since the lens LS has a shape longer in the latitudinal direction LTD (the second direction) than the longitudinal direction LGD (the first direction), it is possible to lead a larger amount of light into the lens LS in the latitudinal direction LTD. Therefore, even when the bottom-emission organic EL elements are used as the light-emitting elements 2951, it is possible to realize satisfactory exposure.

B-2. Second Embodiment

Figure 13:
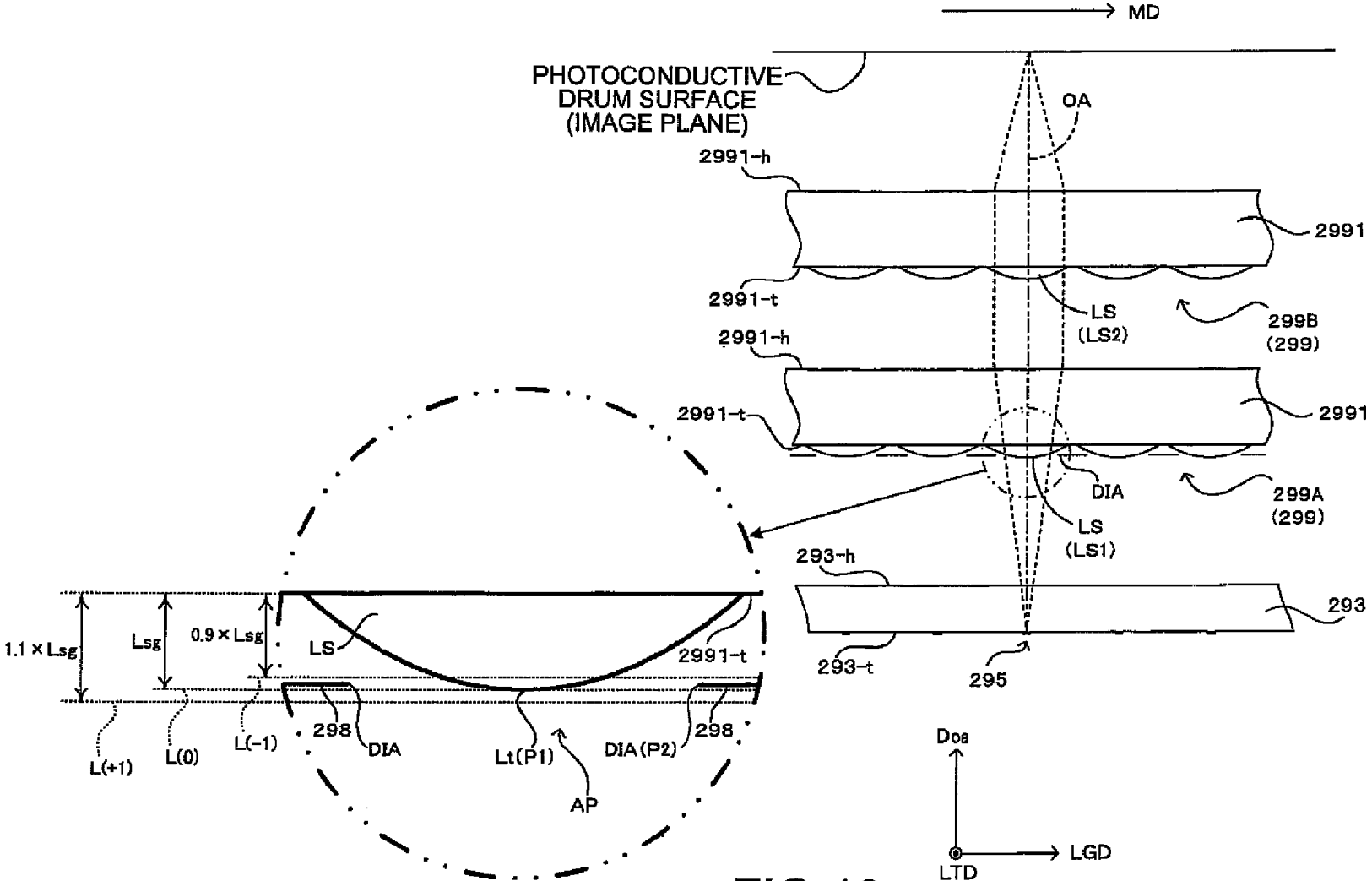
FIG. 13 is a partial sectional view of a second embodiment of the invention.

FIG. 13 is a partial sectional view of a second embodiment of the invention. In the figure, a configuration shown in a large circle of an alternate long and two short dashes line is obtained by enlarging a configuration shown in a small circle of an alternate long and two short dashes line. As shown in FIG. 13, both the lenses LS1 and LS2 formed in the two lens arrays 299A and 299B are convex with respect to the light-emitting element group 295. In other words, incident surfaces of the lenses LS1 and LS2 on which light beams are made incident from the light-emitting element group 295 (the light-emitting elements 2951) are convex. Further, in the second embodiment, a diaphragm DIA is provided between the lens LS1 and the light-emitting element group 295. The diaphragm DIA is formed with an opening AP opened in a flat plate for diaphragm 298.

A positional relation in the light beam traveling direction Doa between the diaphragm DIA and the lens LS (LS1) is as explained below. The diaphragm DIA is arranged in a range within 10% of sag Lsg of the lens LS from a vertex Lt of the lens LS in the light beam traveling direction Doa. The positional relation is explained more in detail with reference to the large circle of the alternate long and two short dashes line in the figure. First, when a straight line that passes the vertex Lt of the lens LS and is parallel to the longitudinal direction LGD is represented as straight line L(0), a distance in the light beam traveling direction Doa between the straight line L(0) and the rear surface 2991-*t* of the lens array substrate 2991 is the sag Lsg of the lens LS. When a straight line that is at the distance of 0.9×Lsg from the rear surface 2991-*t* of the lens array substrate 2991 in the light beam traveling direction Doa and is parallel to the longitudinal direction LGD is represented as straight line L(−1) and a straight line at the distance of 1.1×Lsg from the rear surface 2991-*t* of the lens array substrate 2991 in the light beam traveling direction Doa and is parallel to the longitudinal direction LGD is represented as straight line L(+1) , the diaphragm DIA is arranged between the straight line (−1) and the straight line (+1) in the light beam traveling direction Doa. In particular, in the second embodiment, the diaphragm DIA is present further on the image plane side than the vertex Lt of the lens LS, i.e., arranged between the straight line (0) and the straight line (−1) in the light beam traveling direction Doa. In other words, a position P1 of the vertex Lt in the traveling direction Doa of the light beam with the position of the light-emitting element 2951 set as an origin and a position P2 of the diaphragm DIA in the light beam traveling direction Doa with the position of the light-emitting element 2951 set as an origin satisfy a relation represented by an expression P1≦P2≦P1+0.1×Lsg.

Figure 14:
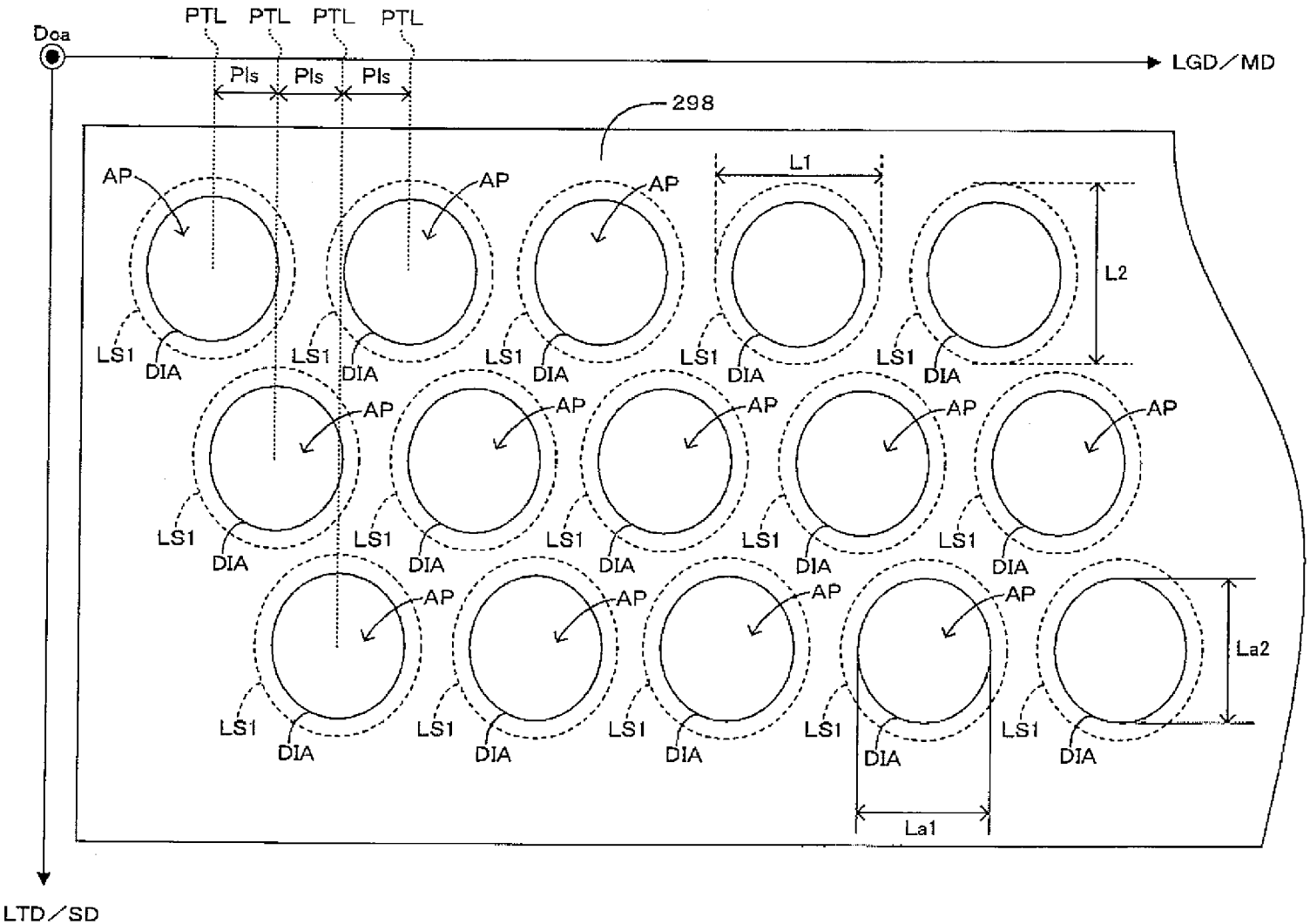
FIG. 14 is a partial plan view of a configuration of diaphragms according to the second embodiment.

FIG. 14 is a partial plan view of a configuration of diaphragms according to the second embodiment. In the figure, the lenses LS1 are indicated by broken lines. This indicates a relation between the lenses LS1 and the diaphragms DIA and does not indicate that the lenses LS1 are provided in the flat plate for diaphragm 298. First, a configuration in plan view of the lenses LS1 in the second embodiment is explained below. The lenses LS1 have an elliptical shape in plan view. Length L1 of the lenses LS1 in the longitudinal direction LGD (lens main scanning width L1) and length L2 of the lenses LS1 in the latitudinal direction LTD (lens sub-scanning width L2) satisfy a relation represented by an expression 1<L2/L1<1.2. The lenses LS1 are arrayed at the lens pitch Pls in the longitudinal direction LGD. On the other hand, the lenses LS1 are arrayed at the lens row pitch Plsr in the latitudinal direction LTD.

A configuration in plan view of the diaphragms is explained. As shown in FIG. 14, plural diaphragms DIA are provided in one to one correspondence with the plural lenses LS1 in the flat plate for diaphragm 298. Geometric centers of gravity of the lenses LS1 and the diaphragms DIA in the correspondence relation coincide with each other. In the second embodiment, length La1 of the diaphragms DIA in the longitudinal direction LGD (diaphragm main scanning diameter La1) and length La2 of the diaphragms DIA in the latitudinal direction LTD (diaphragm sub-scanning diameter La2) satisfy a relation represented by an expression 1<La2/

La1. In particular, in the second embodiment, L2/L1=La1/La1. Moreover, the respective diaphragms DIA have an elliptical shape similar to the shape of the lenses LS1.

In this way, in the second embodiment, the lens main scanning width L1 and the lens sub-scanning width L2 satisfy a relation represented by an expression 1<L2/L1. Therefore, it is possible to lead a large amount of light into the lenses LS1 in the sub-scanning direction SD (the latitudinal direction LTD) without increasing the pitch Pls of the lenses LS disposed in the longitudinal direction LGD.

Such a configuration is advantageous for an increase in resolution because it is unnecessary to increase the lens pitch Pls. A relative positional relation among the lenses LS fluctuates in a range of accuracy of a lens manufacturing process. The positional fluctuation in the lenses LS causes fluctuation in positions of spots formed by the lenses LS. In this case, if the lens pitch Pls is large, such fluctuation in the spot positions appears at a long period compared with target resolution and is conspicuous for human eyes. On the other hand, it is possible to suppress the influence of such fluctuation in the spot positions and realize an increase in resolution by keeping the lens pitch Pls small.

In the second embodiment, the lens main scanning width L1 and the lens sub-scanning width L2 satisfy a relation represented by an expression L2/L1<1.2. With such a configuration, it is possible to suppress a difference between the lens main scanning width L1 and the lens sub-scanning width L2 and easily form lenses having small astigmatism. Therefore, it is possible to simply and easily realize satisfactory exposure. In particular, when lenses are formed by using a die, it is preferable that the lens main scanning width L1 and the lens sub-scanning width L2 satisfy the relation represented by the expression L2/L1<1.2. In the lens formation by the die, the lenses are released from the die by contracting the lenses with respect to the die. In this case, if a difference between the lens main scanning width L1 and the lens sub-scanning width L2 is large, a difference occurs in a degree of the contraction of the lenses between the longitudinal direction LGD (the main scanning direction MD) and the latitudinal direction LTD (the sub-scanning direction SD) and astigmatism tends to occur. On the other hand, when the lens main scanning width L1 and the lens sub-scanning width L2 satisfy a relation represented by an expression L2/L1<1.2, it is possible to suppress the astigmatism to a level at which no problem occurs. Therefore, it is possible to simply and easily realize satisfactory exposure.

In the second embodiment, the diaphragm main scanning diameter La1 and the diaphragm sub-scanning diameter La2 preferably satisfy a relation represented by an expression 1<La2/La1. As explained above, in the second embodiment, the lenses LS1 have a characteristic that the lenses LS1 can capture a large amount of light in the sub-scanning direction SD (the latitudinal direction LTD). On the other hand, the diaphragms DIA block a part of light traveling from the light-emitting elements 2951 to the lenses LS1. Therefore, from the viewpoint of effectively making use of the lens characteristic in this embodiment, in order to suppress unnecessary blocking of the light by the diaphragms DIA and effectively use the light from the light-emitting elements 2951, a shape of the diaphragms DIA is preferably advantageous for leading a large amount of light into the lenses in the sub-scanning direction SD (the latitudinal direction LTD). On the other hand, in the second embodiment, the diaphragm main scanning diameter La1 and the diaphragm sub-scanning diameter La2 satisfy the relation represented by the expression 1<La2/La1. Therefore, it is possible to lead a larger amount of light into the lenses LS1 in the sub-scanning direction SD (the latitudinal direction LTD) and realize satisfactory exposure.

In the second embodiment, the lens main scanning width L1, the lens sub-scanning width L2, the diaphragm main scanning diameter La1, and the diaphragm sub-scanning diameter La2 satisfy the relation represented by the expression L2/L1=La2/La1. Therefore, it is possible to more effectively use the light from the light-emitting elements 2951.

Further, in the second embodiment, the shape of the lenses LS1 and the shape of the diaphragms DIA are formed similar to each other. Therefore, it is possible to more effectively use the light from the light-emitting elements 2951.

In the second embodiment, the diaphragms DIA are present in the range within 10% of the sag Lsg of the lenses LS from the vertexes Lt of the lenses LS1. Therefore, it is possible to suppress unnecessary blocking of the light by the diaphragms DIA and extremely effectively use the light from the light-emitting elements 2951. Moreover, the diaphragms DIA are located further on the image plane side than the vertexes Lt of the lenses LS. Therefore, it is possible to further improve efficiency of use of the light from the light-emitting elements 2951.

C. Modifications

As explained above, in the embodiments, the longitudinal direction LGD and the latitudinal direction LTD are orthogonal to or substantially orthogonal to each other. The main scanning direction MD and the sub-scanning direction SD are orthogonal to or substantially orthogonal to each other. The longitudinal direction LGD and the main scanning direction MD are parallel to or substantially parallel to each other. The latitudinal direction LTD and the sub-scanning direction SD are parallel to or substantially parallel to each other. Therefore, the longitudinal direction LGD and the main scanning direction MD correspond to the "first direction" of the invention and the latitudinal direction LTD and the sub-scanning direction SD correspond to the "second direction" of the invention. The head substrate 293 corresponds to the "light-emitting element substrate" of the invention. The line head 29 corresponds to the "exposure head" of the invention. The photoconductive drum 21 corresponds to the "latent image bearing member" of the invention.

The invention is not limited to the embodiments explained above. Various modifications to the embodiments are possible without departing from the spirit of the invention. For example, in the embodiments, in each of the light-emitting element rows 2951R forming the light-emitting element group 295, the number of the light-emitting elements 2951 arranged in the longitudinal direction LGD is "m" (=4). However, a value of "m" is not limited to 4 and only has to be an integer equal to or larger than 2 and larger than "n" ("n" is the number of the light-emitting element rows 2951R forming the light-emitting element group 295). In the embodiments, in all the light-emitting element rows 2951R, the "m" light-emitting elements 2951 are arranged in the longitudinal direction LGD. However, a form of the light-emitting element rows 2951R is not limited to this. Among the light-emitting element rows 2951R forming the light-emitting element group 295, one light-emitting element row 2951R may be formed by arranging the "m" light-emitting elements 2951 and, on the other hand, the other light-emitting element row 2951R may be formed by arranging (m+q) light-emitting elements 2951. "q" is an integer equal to or larger than 1. In short, the number of the light-emitting elements 2951 arranged in the longitudinal direction LGD of each of the light-emitting element rows 2951R forming the light-emitting element group 295 only has to be equal to or larger than "m". The respective light-emitting element rows 2951R do not have to be formed by the same number of the light-emitting elements 2951. In the embodiments, the number of the light-emitting element rows 2951R arranged in the latitudinal direction LTD in the light-emitting element group 295 is "n" (=2). However, a value of "n" is not limited to 2 and only has to be an integer equal to or larger than 1. Therefore, the light-emitting element group 295 can also be formed as explained below.

Figure 15:
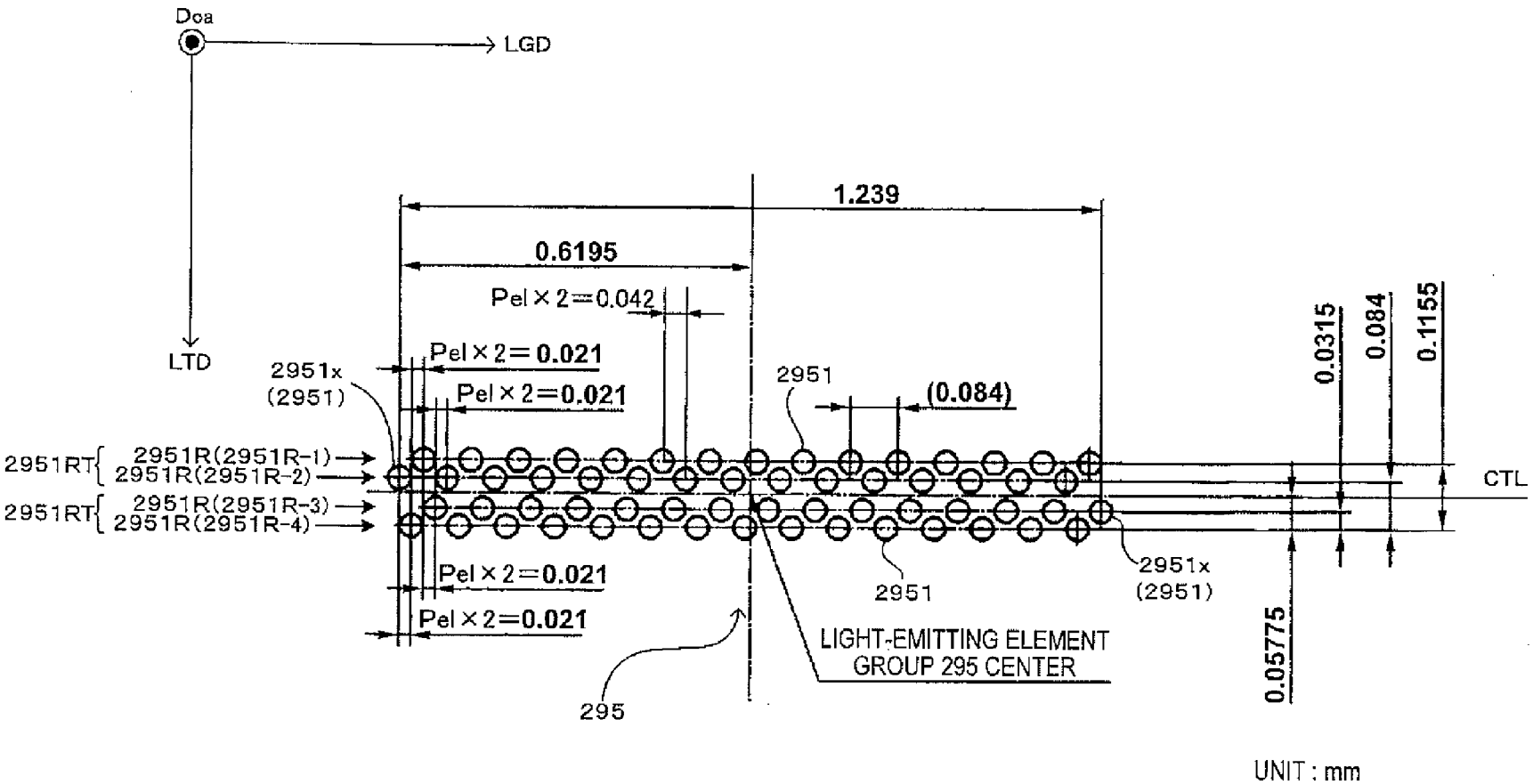
FIG. 15 is a plan view of another configuration of a light-emitting element group.
Figure 16:
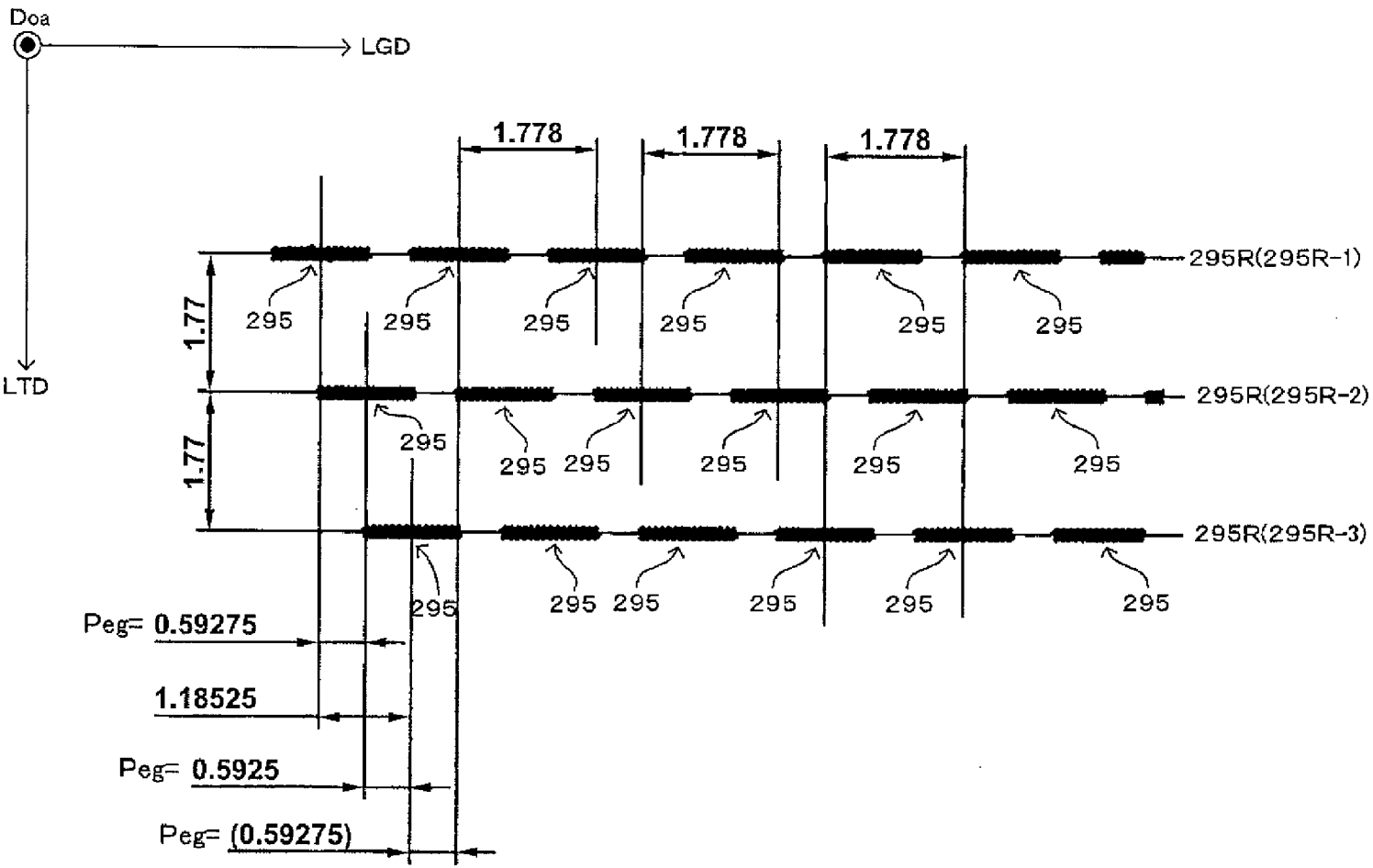
FIG. 16 is a diagram of a rear surface of a head substrate on which a plurality of the light-emitting element groups shown in FIG. 15 are arranged

FIG. 15 is a plan view of another configuration of the light-emitting element group. FIG. 16 is a diagram of a configuration on a rear surface of a head substrate on which a plurality of the light-emitting element groups shown in FIG. 15 are arranged. In FIG. 16, the rear surface is viewed from a front surface of the head substrate. In the other configuration shown in FIG. 15, fifteen light-emitting elements 2951 are arranged in the longitudinal direction LGD to form the light-emitting element row 2951R (i.e., in an example shown in FIG. 15, m=15). In the light-emitting element row 2951R, the respective light-emitting elements 2951 are arranged at a pitch (=0.084 [mm]) four times as large as the element pitch Pel (=0.021 [mm]). The four light-emitting element rows 2951R (2951R-1, 2951R-2, 2951R-3, and 2951R-4) configured in this way are arranged in the latitudinal direction LTD (i.e., in the example shown in FIG. 15, n=4). In the latitudinal direction LTD, a pitch between the light-emitting element row 2951R-4 and the light-emitting element row 2951R-1 is 0.1155 [mm], a pitch between the light-emitting element row 2951R-4 and the light-emitting element row 2951R-2 is 0.084 [mm], and a pitch between the light-emitting element row 2951R-4 and the light-emitting element row 2951R-3 is 0.0315 [mm]. When a straight line that passes the center (center of gravity) of the light-emitting element group 295 and is parallel to the latitudinal direction LTD is represented as center line CTL, a pitch between each of the light-emitting element row 2951R-1 and the light-emitting element row 2951R-4 is 0.05775 [mm].

In FIG. 15, one light-emitting element row set 2951RT is formed by the two light-emitting element rows 2951R-1 and 2951R-2 above the center line CTL. One light-emitting element row set 2951RT is formed by the two light-emitting element rows 2951R-3 and 2951R-4 below the center line CTL. In each of the light-emitting element row sets 2951RT, the two light-emitting element rows 2951R are shifted from each other by a distance (=0.042 [mm]) twice as large as the element pitch Pel (=0.021 [mm]) in the longitudinal direction LGD. Moreover, the two light-emitting element row sets 2951RT are shifted from each other by the element pitch Pel (=0.021 [mm]) in the longitudinal direction LGD. Therefore, the four light-emitting element rows 2951R are shifted from one another by the pixel pitch Pel (=0.021 [mm]) in the longitudinal direction LGD. As a result, positions of the respective light-emitting elements 2951 are different in the longitudinal direction LGD. When the light-emitting elements 2951 located at both ends in the longitudinal direction LGD of the light-emitting element group 295 is represented as end light-emitting elements 2951*x*, a pitch between the end light-emitting elements 2951*x* in the longitudinal direction LGD is 1.239 [mm] and a pitch between the end light-emitting elements 2951*x* and the center of the light-emitting element group 295 is 0.6195 [mm].

In an example shown in FIG. 16, a plurality of the light-emitting element groups 295 shown in FIG. 15 are two-dimensionally arranged. As shown in FIG. 16, the light-emitting element group row 295R is formed by arranging the light-emitting element groups 295 in the longitudinal direction LGD. In the light-emitting element group row 295R, the respective light-emitting element groups 295 are arranged at a pitch (=1.778 [mm]) three times as large as the light-emitting element group pitch Peg. Three light-emitting element group rows 295R (295R-1, 295R-2, and 295R-3) formed in this way are arranged at the light-emitting element group row pitch Pegr (=1.77 [mm]) in the latitudinal direction LTD. The respective light-emitting element group rows 295R are shifted from one another by the light-emitting element group pitch Peg (about 0.593 [mm]) in the longitudinal direction LGD. The light-emitting element group row 295R-1 and the light-emitting element group row 295R-2 are shifted by 0.59275 [mm] in the longitudinal direction LGD. The light-emitting element group row 295R-2 and the light-emitting element group row 295R-3 are shifted by 0.5925 [mm] in the longitudinal direction LGD. The light-emitting element group row 295R-3 and the light-emitting element group row 295R-1 are shifted by 0.59275 [mm] in the longitudinal direction LGD. Therefore, the light-emitting element group row 295R-1 and the light-emitting element group row 295R-3 are shifted by 1.18525 [mm] in the longitudinal direction LGD.

In the embodiments, the three lens rows LSR are arranged in the latitudinal direction LTD. However, the number of the lens rows LSR is not limited to three. Therefore, for example, as explained in another embodiment below, the number of the lens rows LSR may be one.

Figure 17:
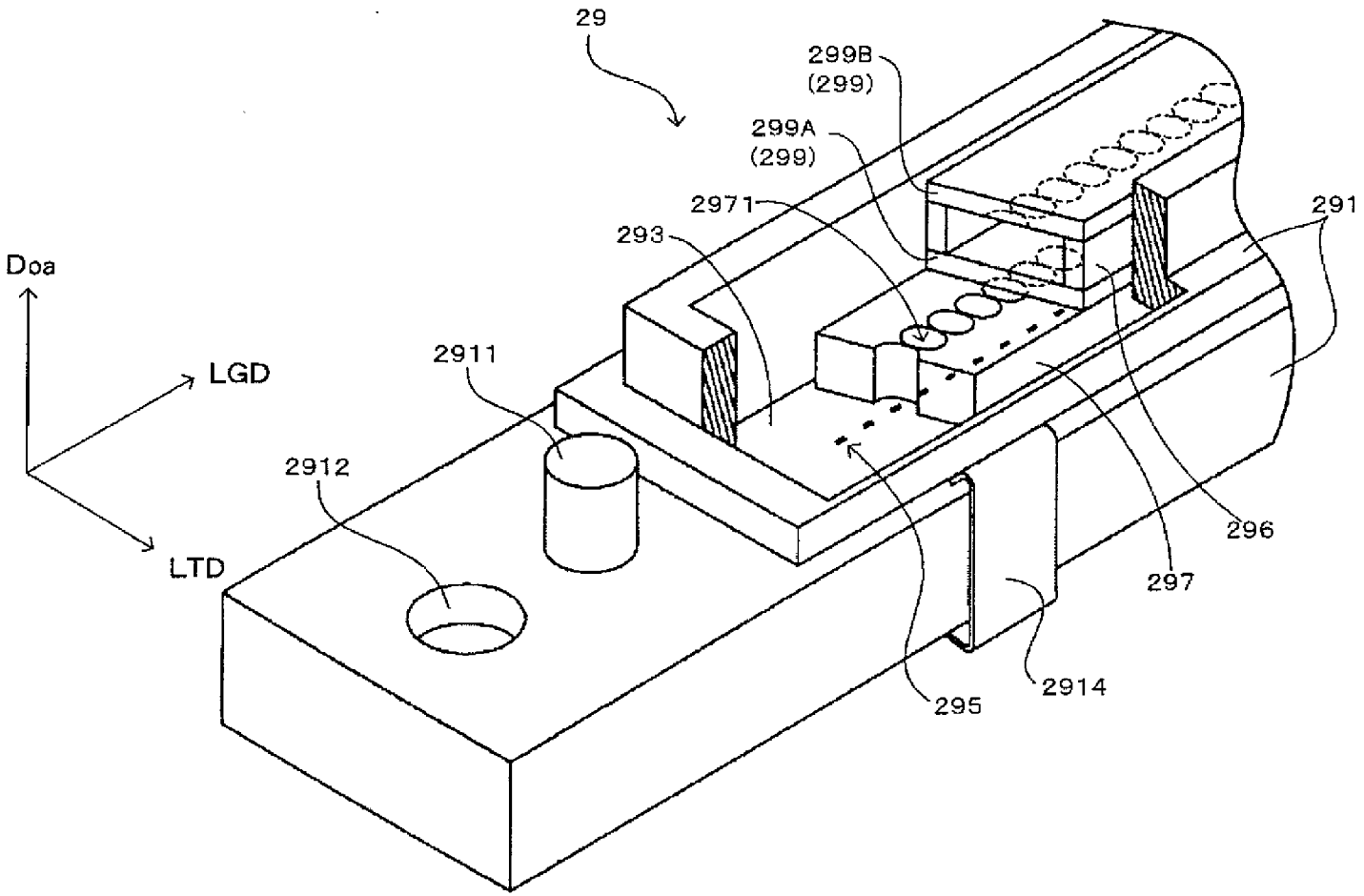
FIG. 17 is a perspective view of a line head according to another embodiment.
Figure 18:
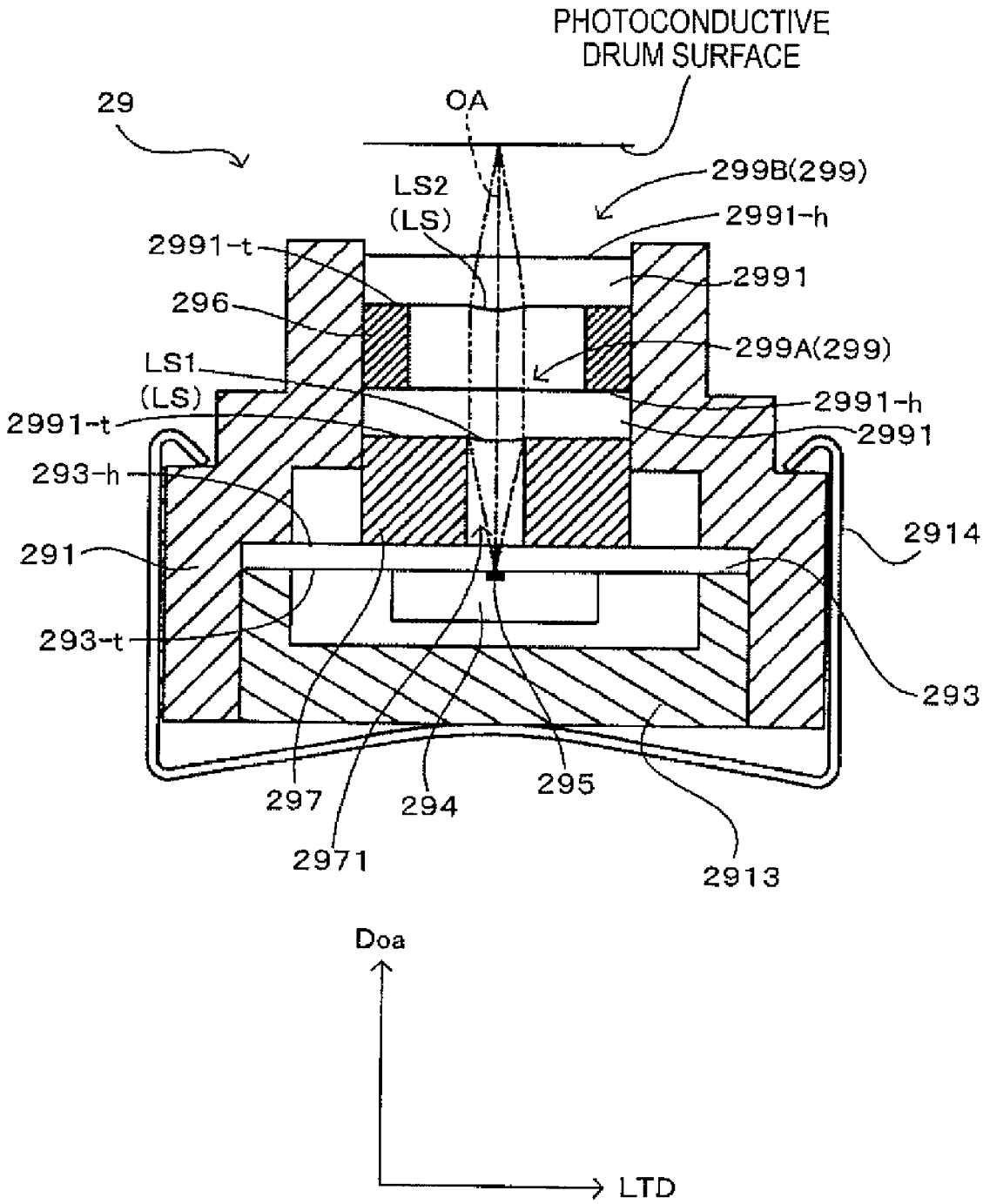
FIG. 18 is a partial sectional view in a latitudinal direction of the line head shown in FIG. 17.
Figure 19:
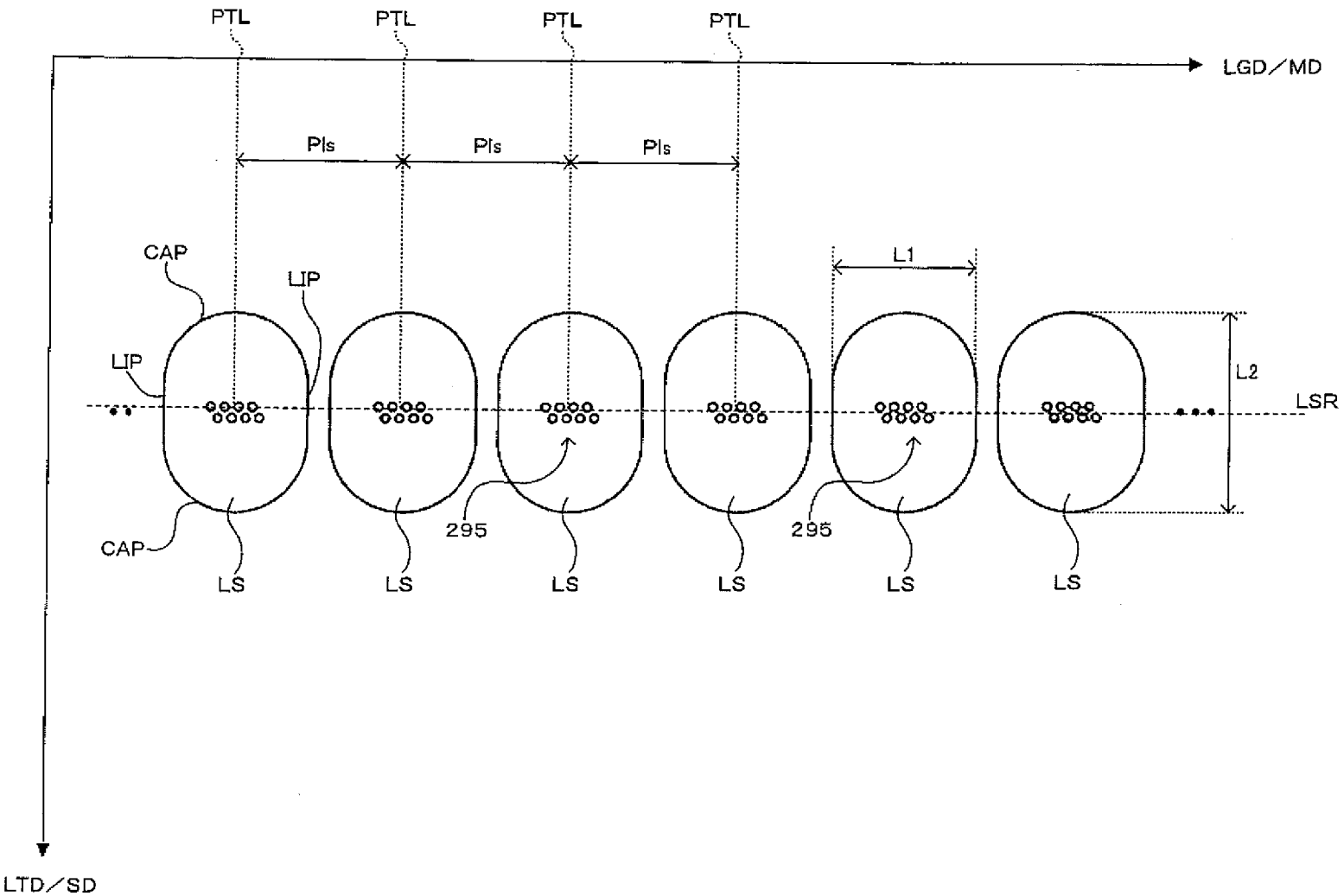
FIG. 19 is a plan view of a relation between light-emitting element groups and lenses according to the other embodiment.

FIG. 17 is a perspective view of a line head according to another embodiment. FIG. 18 is a partial sectional view in a latitudinal direction of the line head shown in FIG. 17. A section parallel to an optical axis of lenses is shown in FIG. 18. FIG. 19 is a plan view of a relation between light-emitting element groups and lenses according to the other embodiment. In FIG. 19, the light-emitting element groups and the lenses are viewed from the image plane side (the light beam traveling direction Doa side). In the following explanation, differences between the embodiment explained with reference to FIG. 5 and the like and the other embodiment are mainly explained. Components same as those shown in FIG. 5 and the like are denoted by the same reference numerals and signs and explanation of the components is omitted.

In the other embodiment, as in the embodiments explained above, the head substrate 293 on which the light-emitting element groups 295 are arranged is provided and the two lens arrays 299A and 299B are provided side by side in the light beam traveling direction Doa. The plural light-emitting element groups 295 are arranged side by side in the longitudinal direction LGD on the head substrate 293. In each of the lens arrays 299A and 299B, the lens LS is provided for each of the light-emitting element groups 295. The plural lenses LS are arranged at the lens pitch Pls in the longitudinal direction LGD to form one lens row LSR. In the other embodiment, in each of the lens arrays 299A and 299B, the lenses LS are formed on the rear surface 2991-*t* of the lens array substrate 2991.

As shown in FIG. 19, the lens LS has a shape formed by connecting U and reverse U. Therefore, an outer circumference of the lens LS has a linear portion LIP extending in the latitudinal direction LTD and a circular arc portion CAP connected to the linear section LIP. The lens longitudinal direction length L1 and the lens latitudinal direction length L2 of the lens LS satisfy a relation represented by an expression L2>L1. The light guide hole 2971 of the light blocking member 297 has a shape corresponding to the shape of the lens LS.

As explained above, in the other embodiment, as in the embodiments explained above, the lens LS has a shape longer in the latitudinal direction LTD (the second direction) than the longitudinal direction LGD (the first direction). Therefore, the lens LS can capture a larger amount of light in the latitudinal direction LTD without an increase in a lens pitch Pls of the plural lenses LS arranged in the longitudinal direction LGD. Therefore, it is possible to lead a larger amount of light into the lenses LS even at high resolution and realize satisfactory exposure.

Figure 20:
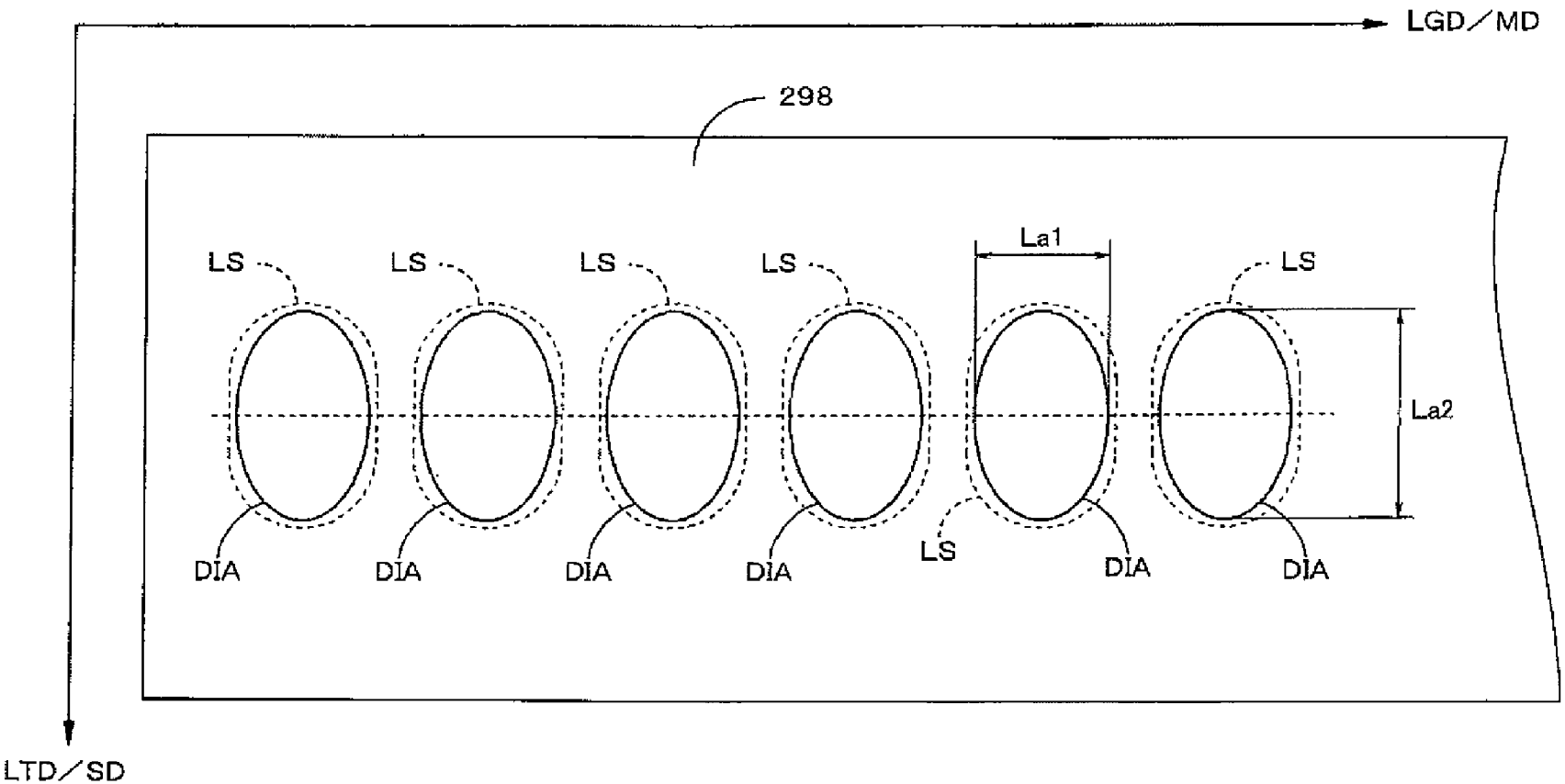
FIG. 20 is a diagram of a configuration in which diaphragms are provided instead of light blocking members in a configuration shown in FIGS. 17 to 19.

In the configuration shown in FIGS. 17 to 19, the diaphragms DIA may be provided instead of the light blocking member 297. FIG. 20 is a partial plan view of a configuration in which diaphragms are provided instead of the light blocking member in the configuration shown in FIGS. 17 to 19. In FIG. 20, the lenses LS are indicated by broken lines. This indicates a relation between the lenses LS and the diaphragms DIA and does not indicate that the lenses LS are provided on the flat plate for diaphragm 298. As shown in the figure, the plural diaphragms DIA are provided in the flat plate for diaphragm 298 in one to one correspondence with the plural lenses LS. The lenses LS have a shape formed by connecting U and reverse U. On the other hand, the diaphragms DIA have an elliptical shape. The diaphragm main scanning diameter La1 and the diaphragm sub-scanning diameter La2 satisfy a relation represented by an expression 1<La2/La1. Therefore, it is possible to realize satisfactory exposure effectively making use of the lens characteristic that the lens can capture a larger amount of light in the sub-scanning direction SD (the latitudinal direction LTD).

In the embodiments explained above, the lens array 299 is configured by forming the lenses LS on the front surface 2991-*h* or the rear surface 2991-*t* of the lens array substrate. However, a form of the lens array is not limited to this. The lenses LS may be formed on both the surfaces 2991-*t* and 2991-*h* of the lens array substrate to configure the lens array 299.

In the embodiments explained above, the two lens arrays 299 are used. However, the number of lens arrays 299 is not limited to this.

In the embodiments explained above, the organic EL elements are used as the light-emitting elements 2951. However, elements other than the organic EL elements may be use as the light-emitting elements 2951. For example, LEDs (Light Emitting Diodes) may be used as the light-emitting elements 2951.

EXAMPLES

Examples of the invention are explained below. However, it goes without saying that the invention is not limited by the examples explained below and can be modified and carried out as appropriate without departing from the spirit of the invention. All such modifications are included in the technical scope of the invention.

First Example

Figure 21:
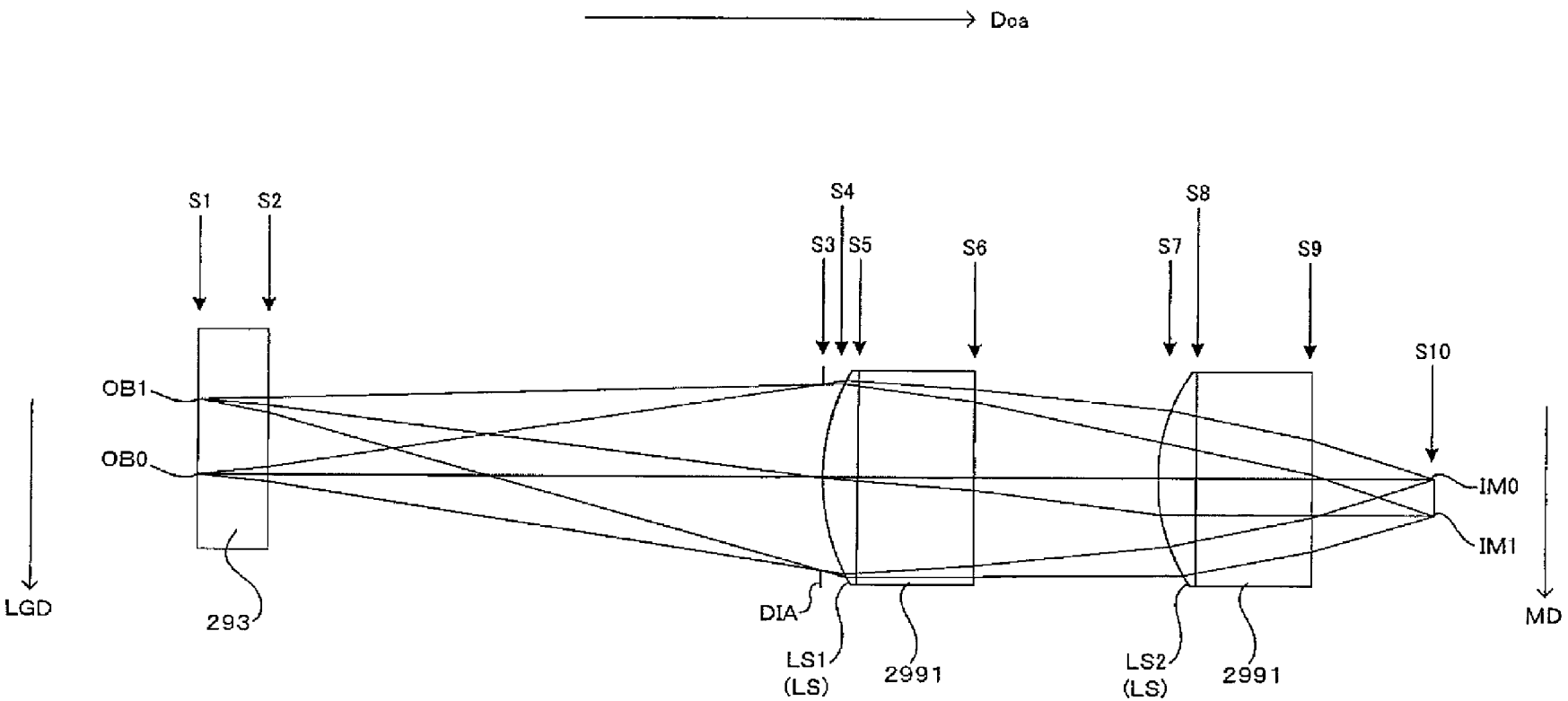
FIG. 21 is a diagram of an optical system in a first example.

FIG. 21 is a diagram of an optical system in a first example. In FIG. 21, a section in the main scanning direction MD is shown. In this example, the diaphragm DIA is provided in front of the first lens LS1 in the light beam traveling direction Doa. Light beams narrowed by the diaphragm DIA are made incident on the first lens LS1. In the figure, optical paths of light beams emitted from an object point OB0 on the optical axis OA and focused at an image point IM0 and optical paths of light beams emitted from an object point OB1 different from the optical axis OA and focused at an image point IM1 are shown. Components other than the diaphragm DIA are substantially the same as those explained in the other embodiment.

Figure 22:
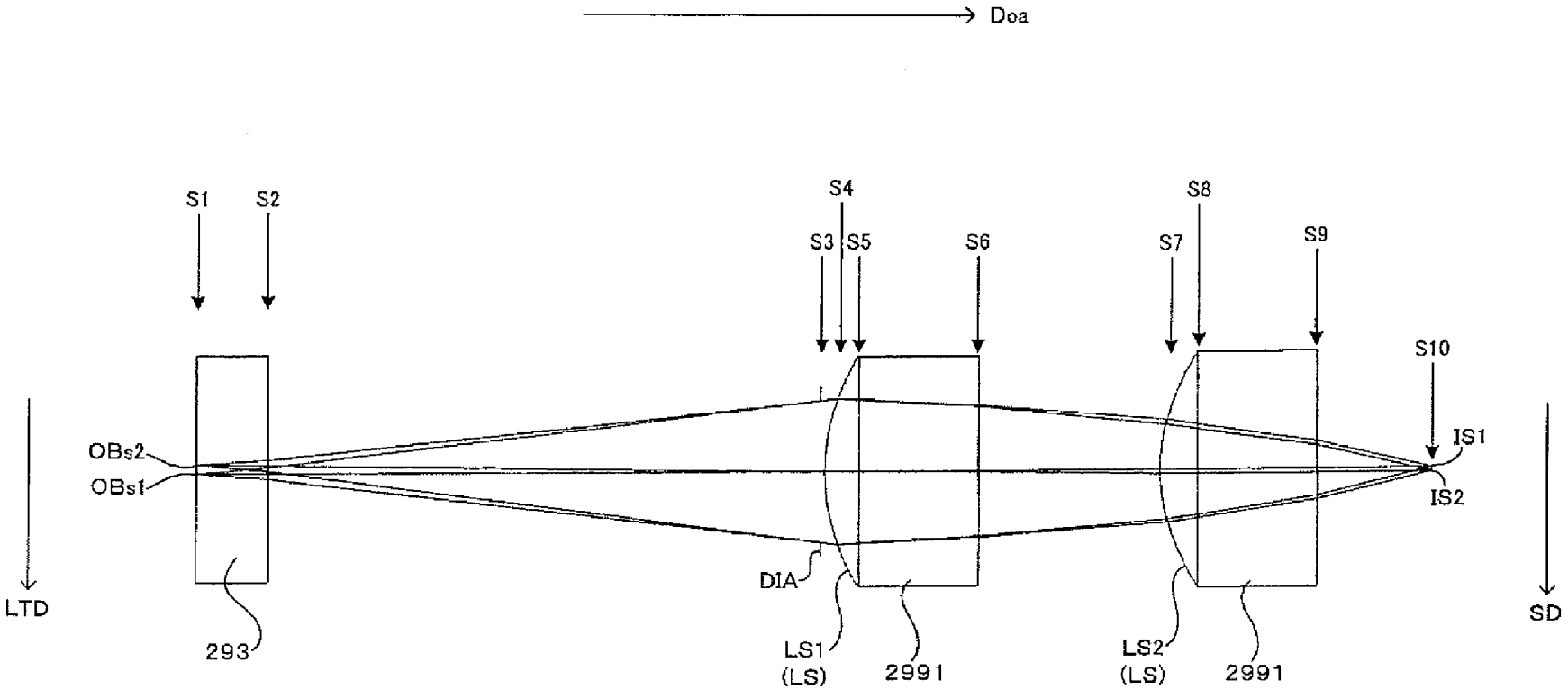
FIG. 22 is a diagram of the optical system in the first example.

FIG. 22 is a diagram of the optical system in the first example. In FIG. 22, a section in the sub-scanning direction SD is shown. In the figure, optical paths of light beams emitted from an object point OBs1 and focused at an image point IS1 and optical paths of light beams emitted from an object point OBs2 and focused at an image point IS2 are shown. As shown in FIGS. 21 and 22, the optical system in the first example is an inverting optical system.

FIG. 23 is a table of optical system parameters in the first example. As shown in the figure, the wavelength of light beams emitted from the light-emitting elements is 690 [nm]. The lens longitudinal direction length L1 is 1.4 [mm] and the lens latitudinal direction length L2 is 1.63 [mm]. A relation represented by an expression L2>L1 is satisfied. FIG. 24 is a table of data of the optical system in the first example shown in FIG. 21. As shown in the figure, in this optical system, both a lens surface (a surface number S4) of the first lens LS1 and a lens surface (a surface number S7) of the second lens LS2 are free-form surfaces (XY polynomial surfaces). FIG. 25 is a diagram of a definition formula for the XY polynomial surface. A lens surface shape of the first lens LS1 is given by the definition formula and coefficients shown in FIG. 26. A lens surface shape of the second lens LS2 is given by the definition formula and coefficients shown in FIG. 27. FIG. 26 is a table of coefficient values of the surface S4 of the optical system in the first example. FIG. 27 is a diagram of coefficient values of the surface S7 of the optical system in the first example.

In this example, as in the embodiments explained above, the lens LS has a shape longer in the latitudinal direction LTD (the second direction) than the longitudinal direction LGD (the first direction). Therefore, the lens LS can capture a larger amount of light in the latitudinal direction LTD without an increase in the lens pitch Pls of the plural lenses LS arranged in the longitudinal direction LGD. Therefore, it is possible to lead a larger amount of light into the lenses LS even at high resolution and realize satisfactory exposure.

In this example, the lenses LS of the lens array 299 are the free-form lenses. The free-form lenses are lenses, lens surfaces of which are free-form surfaces. Therefore, a focusing characteristic of the lenses is improved and it is possible to realize more satisfactory exposure.

Second Example

Figure 28:
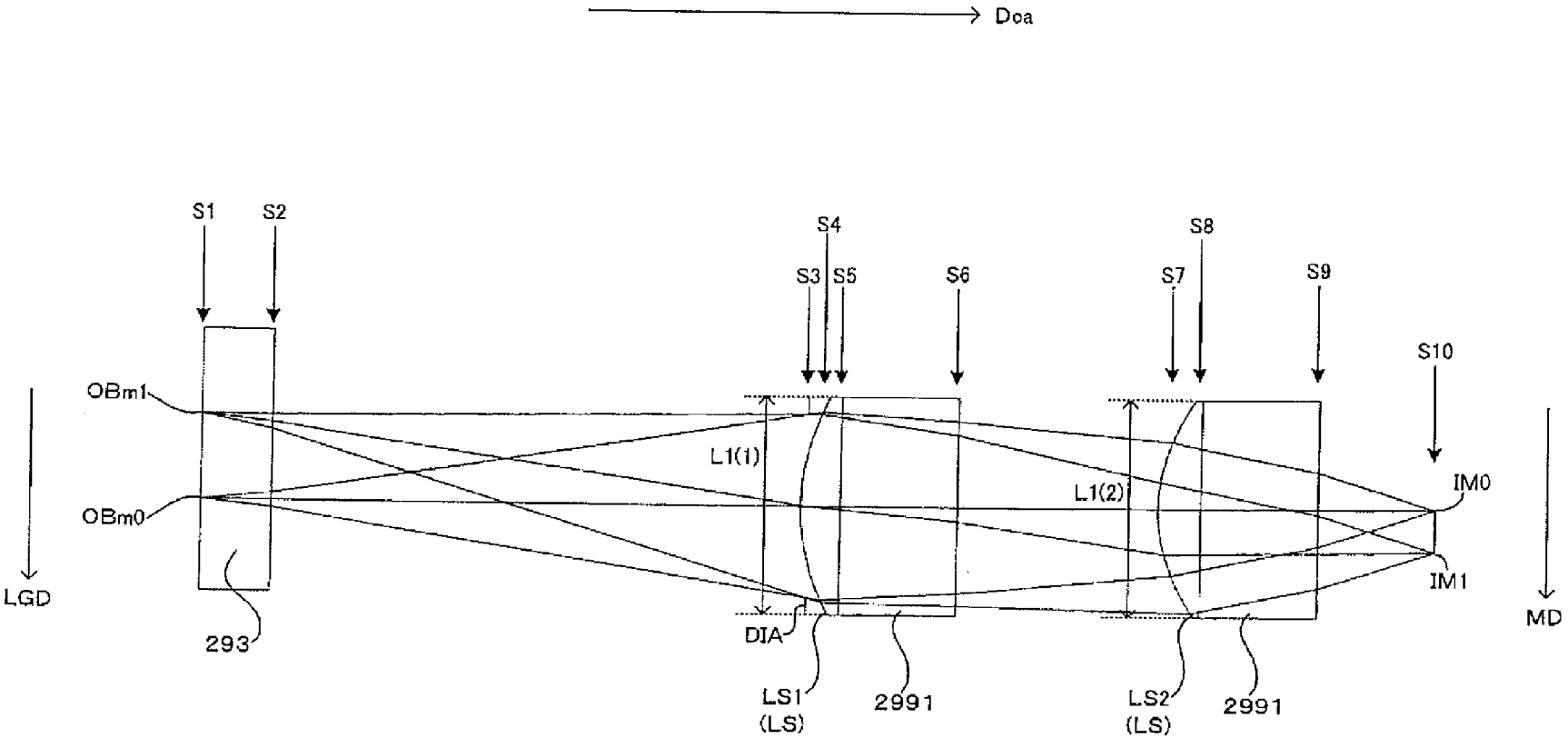
FIG. 28 a diagram of an optical system in a second example.
Figure 29:
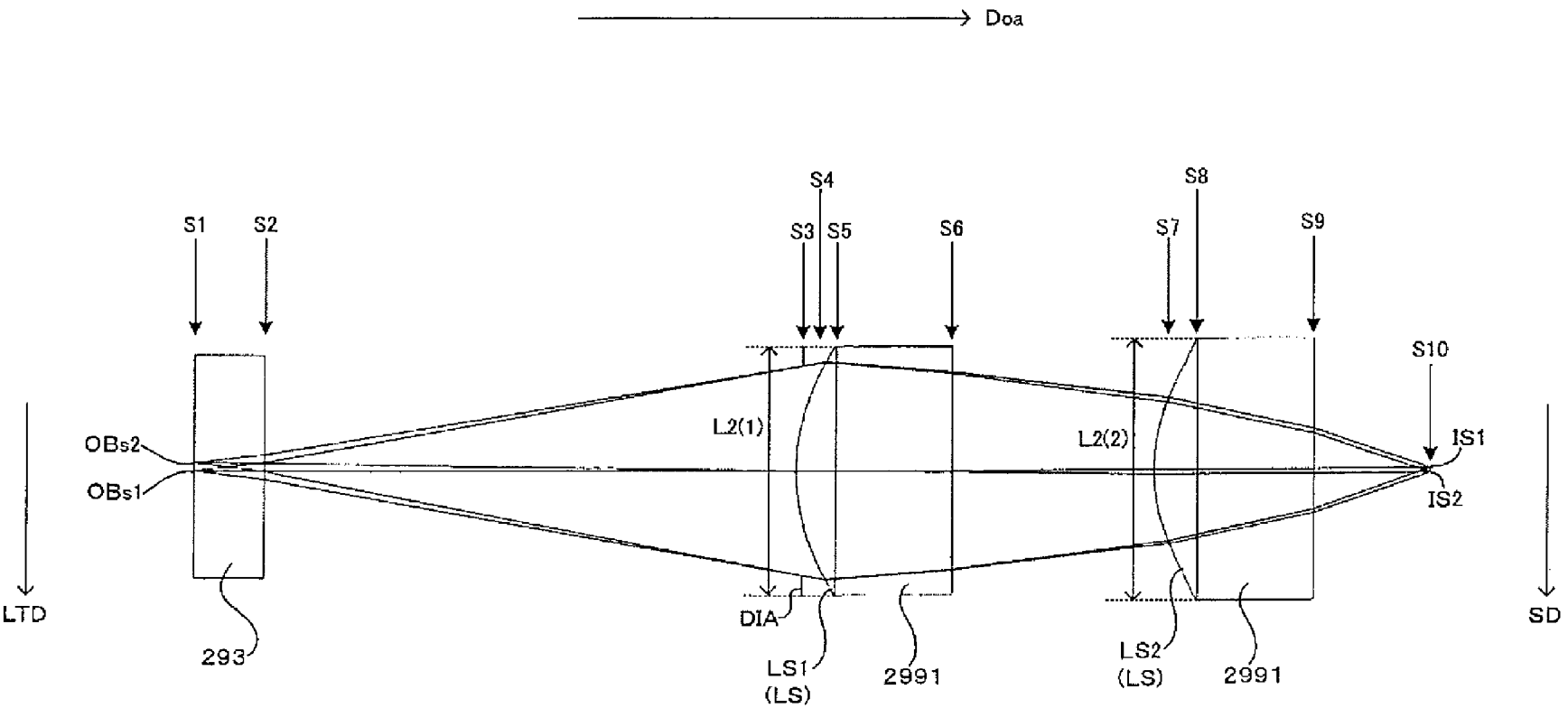
FIG. 29 is a diagram of the optical system in the second example.

FIG. 28 is a diagram of an optical system in a second example. In FIG. 28, a section in the main scanning direction MD is shown. FIG. 29 is a diagram of the optical system in the second example. In FIG. 29, a section in the sub-scanning direction SD is shown. In this example, the diaphragm DIA is provided in front of the first lens LS1 in the light beam traveling direction Doa. Light beams narrowed by the diaphragm DIA are made incident on the first lens LS1. The light beams made incident on the first lens LS1 are focused by the first lens LS1 and the second lens LS2. In FIG. 28, optical paths of light beams emitted from an object point OBm0 on the optical axis OA and focused at the image point IM0 and optical paths of light beams emitted from an object point Obm1 different from the optical axis OA and focused at the image point IM1 are shown. In FIG. 29, optical paths of light beams emitted from an object point OBs1 and focused at an image point IS1 and optical paths of light beams emitted from an object point OBs2 and focused at an image point IS2 are shown. As shown in the figures, the optical system in the second example is an inverting reduction optical system.

FIG. 30 is a table of optical system parameters in the second example. As shown in the figure, the wavelength of light beams emitted from the light-emitting elements is 690 [nm]. A shape of the diaphragm DIA is elliptical. The diaphragm main scanning diameter La1 (diaphragm longitudinal direction length La1) is 1.4 [mm] and the diaphragm sub-scanning diameter La2 (diaphragm latitudinal direction length La2) is 1.6 [mm]. Therefore, a ratio La2/La1 is 1.14. A first lens main scanning diameter L1(1) (first lens longitudinal direction length L1(1)) is 1.66 [mm] and a first lens sub-scanning diameter L2(1) (first lens latitudinal direction length L2(1)) is 1.9 [mm]. Therefore, a ratio L2(1)/L1(1) is 1.14. A second lens main scanning diameter L1(2) (second lens longitudinal direction length L1(2)) is 1.66 [mm] and a second lens sub-scanning diameter L2(2) (first lens latitudinal direction length L2(2)) is 2.0 [mm]. Therefore, a ratio L2(2)/L1(2) is 1.2. A "lens main scanning effective diameter" is, when the first lens LS1 and the second lens LS2 are regarded as one lens, an effective diameter in the main scanning direction MD of the lens. A "lens sub-scanning effective diameter" is, when the first lens LS1 and the second lens LS2 are regarded as one lens (focusing optical system), an effective diameter in the main scanning direction SD of the lens. A space "number of lens rows" indicates that this example corresponds to a line head having one lens row LSR.

FIG. 31 is a table of data of the optical system shown in FIGS. 28 and 29. As shown in the figure, in this optical system, both the lens surface (the surface number S4) of the first lens LS1 and the lens surface (the surface number S7) of the second lens LS2 are free-form surfaces (XY polynomial surfaces). A lens surface shape of the first lens LS1 is given by the definition formula for the XY polynomial surface shown in FIG. 25 and coefficients shown in FIG. 32. A lens surface shape of the second lens LS2 is given by the definition formula and coefficients shown in FIG. 33. FIG. 32 is a table of coefficient values of the surface S4 of the optical system in the second example. FIG. 33 is a diagram of coefficient values of the surface S7 of the optical system in the second example.

In this example, as in the embodiments explained above, the lens main scanning width L1 (L1(1) or L1(2)) and the lens sub-scanning width L2 (L2(1) or L2(2)) satisfy a relation represented by an expression 1<L2/L1. Therefore, it is possible to lead a large amount of light into the lens LS1 in the sub-scanning direction SD (the latitudinal direction LTD) and perform satisfactory exposure without increasing the pitch Pls of the lenses LS disposed in the longitudinal direction LGD.

Such a configuration is advantageous for an increase in resolution because it is unnecessary to increase the lens pitch Pls. A relative positional relation among the lenses LS fluctuates in a range of accuracy of a lens manufacturing process. The positional fluctuation in the lenses LS causes fluctuation in positions of spots formed by the lenses LS. In this case, if the lens pitch Pls is large, such fluctuation in the spot positions appears at a long period compared with target resolution and is conspicuous for human eyes. On the other hand, it is possible to suppress the influence of such fluctuation in the spot positions and realize an increase in resolution by keeping the lens pitch Pls small.

The lens main scanning width L1(1) and the lens sub-scanning width L2(1) satisfy a relation represented by an expression L2(1)/L1(1)<1.2. Therefore, since it is possible to suppress a difference between the lens main scanning width L1(1) and the lens sub-scanning width L2(1) and easily form lenses having small astigmatism, it is possible to simply and easily realize satisfactory exposure.

In the second example, the diaphragm main scanning diameter La1 and the diaphragm sub-scanning diameter La2 satisfy a relation represented by an expression 1<La2/La1. Therefore, it is possible to lead a larger amount of light into the lens LS1 in the sub-scanning direction SD (the latitudinal direction LTD) and realize satisfactory exposure.

In the second example, the first lens main scanning width L1(1), the first lens sub-scanning width L2(1), the diaphragm main scanning diameter La1, and the diaphragm sub-scanning diameter La2 satisfy a relation represented by an expression L2(1)/L1(1)=La2/La1 (=1.14). Therefore, it is possible to more effectively use the light from the light-emitting elements 2951.

What is claimed is:

1. An exposure head comprising:

a lens array in which lenses are disposed in a first direction;

a light-emitting element substrate on which light-emitting elements that emit light to be focused by the lenses are disposed in the first direction: and diaphragms disposed between the light-emitting elements and the lenses, wherein the diaphragms are disposed in one-to-one correspondence with the lenses and block a part of light traveling from the light-emitting elements, the lenses focus light through the diaphragms on an image plane disposed in an opposite direction to the light-emitting element substrate, and length L1 of the lenses in the first direction and length L2 of the lenses in a second direction orthogonal to the first direction have a relation represented by an expression 1<L2/L1<1.2.

2. The exposure head according to claim 1, wherein length La2 of the diaphragms in the first direction and length La2 of the diaphragms in the second direction have a relation represented by an expression 1<La2/La1.

3. The exposure head according to claim 2, wherein the length L1 of the lenses in first direction, the length L2 of the lenses in the second direction, the length La1 of the diaphragms in the first direction, and the length La2 of the diaphragms in the second direction have a relation represented by an expression L2/L1=La2/La1.

4. The exposure head according to claim 3, wherein a shape of the lenses and a shape of the diaphragms are similar.

5. The exposure head according to claim 1, wherein a shape of the diaphragms is elliptical.

6. The exposure head according to claim 5, wherein the diaphragms are disposed further on an image plane side than vertexes of the lenses.

7. The exposure head according to claim 1, wherein surfaces of the lenses on which the light is made incident from the light-emitting elements are convex.

8. The exposure head according to claim 1, wherein the lenses are free-form lenses.

9. The exposure head according to claim 1, wherein the light-emitting elements are organic EL elements.

10. The exposure head according to claim 1, wherein the light-emitting element substrate further comprises light-emitting elements that emit light to be focused by the lens that are disposed in the second direction.

11. An image forming apparatus comprising:

a photoconductive drum on which a latent image is formed; and an exposure head that forms the latent image on the photoconductive drum and having:

a lens array in which lenses are arrayed in a first direction;

a light-emitting element substrate on which light-emitting elements that emit light to be focused by the lenses are disposed in the first direction; and diaphragms disposed between the light-emitting elements and the lenses, wherein the diaphragms are disposed in one-to-one correspondence with the lenses and block a part of light traveling from the light emitting elements, the lenses focus light through the diaphragm on the photoconductive drum disposed in an opposite direction to the light-emitting element substrate, and length L1 of the lenses in the first direction and length L2 of the lenses in a second direction orthogonal to the first direction have a relation represented by an expression $1<L2/L1<1.2$.

* * * * *